US007013883B2

(12) United States Patent
Shimada et al.

(10) Patent No.: US 7,013,883 B2
(45) Date of Patent: Mar. 21, 2006

(54) IGNITION COIL FOR USE IN ENGINE AND ENGINE HAVING PLASTIC CYLINDER HEAD COVER

(75) Inventors: Junichi Shimada, Mito (JP); Noboru Sugiura, Mito (JP); Yoichi Anzo, Hitachinaka (JP); Eiichiro Kondo, Hitachinaka (JP); Kazutoshi Kobayashi, Hitachinaka (JP); Takahide Kosai, Hitachinaka (JP); Toshiaki Ueda, Urizura-machi (JP)

(73) Assignees: Hitachi, Ltd., Tokyo (JP); Hitachi Car Engineering Co., Ltd., Hitachinaka (JP)

( * ) Notice: Subject to any disclaimer, the term of this patent is extended or adjusted under 35 U.S.C. 154(b) by 0 days.

(21) Appl. No.: 10/448,128

(22) Filed: May 30, 2003

(65) Prior Publication Data

US 2004/0069288 A1 Apr. 15, 2004

Related U.S. Application Data

(60) Continuation of application No. 09/983,093, filed on Oct. 23, 2001, now Pat. No. 6,571,784, which is a division of application No. 09/424,480, filed as application No. PCT/JP98/02244 on May 22, 1998, now Pat. No. 6,332,458.

(30) Foreign Application Priority Data

May 23, 1997 (JP) ..... 9-134069
Jul. 7, 1997 (JP) ..... 9-181559

(51) Int. Cl.
*F02P 15/00* (2006.01)

(52) U.S. Cl. ..... 123/634; 123/169 PA

(58) Field of Classification Search ..... 123/634, 123/169 PA, 169 P, 169 R, 143 R; 174/35 SM; 336/198, 96, 107
See application file for complete search history.

(56) References Cited

U.S. PATENT DOCUMENTS 5,189,373 A * 2/1993 Murata et al. ..... 324/399

(Continued)

*Primary Examiner*—Mahmoud Gimie
(74) *Attorney, Agent, or Firm*—Crowell & Moring LLP

(57) ABSTRACT

To improve an anti-heat shock performance and an electric field concentration relaxation (an insulation performance) between a secondary coil and a center core, to attain a narrow diameter structure in an individual ignition type ignition coil and further to improve an assembling working of the ignition coil. The individual ignition type ignition coil is adopted to an engine having a plastic head cover. A secondary coil 3 is positioned at an inner side of a primary coil 5 and between a secondary bobbin 2 and a center core 1 a soft epoxy resin 17 is filled up. In the secondary bobbin 2, a secondary coil low voltage side is a potting side of the soft epoxy resin 17 and an inclination having a difference in an inner diameter is provided on the inner diameter in which the secondary coil low voltage side is formed large and secondary coil high voltage side is formed small. In the secondary bobbin, a thickness in the secondary coil low voltage side is formed thin and a thickness in the secondary coil high voltage side is formed thick. The soft epoxy resin 17 has a dent 17' according to a compression molding and has a glass transition point Tg which satisfies a condition of [an allowable stress of the secondary bobbin > a generation stress at (from −40° C. to a glass transition point of an insulation resin)]. The secondary bobbin is formed by PPS and the primary bobbin is set to the primary coil at outer side of the secondary assembling body and under an assembling condition the winding is carried out.

7 Claims, 21 Drawing Sheets

U.S. PATENT DOCUMENTS 5,603,307 A * 2/1997 Morita et al. ..... 123/633
5,720,264 A * 2/1998 Oosuka et al. ..... 123/634
5,842,457 A * 12/1998 Terakado et al. ..... 123/613
6,196,209 B1 * 3/2001 Shimada et al. ..... 123/634
6,213,109 B1 * 4/2001 Satoo et al. ..... 123/634
6,237,578 B1 * 5/2001 Satoo et al. ..... 123/634
6,343,595 B1 * 2/2002 Nakabayashi et al. ..... 123/634
6,386,189 B1 * 5/2002 Shimada et al. ..... 123/634
6,571,784 B1 * 6/2003 Shimada et al. ..... 123/634

* cited by examiner (a)

σ 1 : GENERATION STRESS OF SECONDARY BOBBIN AT −40°C ··· Tg1

σ 2 : GENERATION STRESS OF SECONDARY BOBBIN AT −40°C ··· Tg2

(b)

POTENTIALS OF SECONDARY COIL AND CENTER CORE

IGNITION COIL FOR USE IN ENGINE AND ENGINE HAVING PLASTIC CYLINDER HEAD COVER

TECHNICAL FIELD

The present invention relates to an individual coil type ignition coil for use in an engine which is prepared for every ignition coil each of an engine and is used by directly connecting to said respective ignition coil and an engine having a plastic head cover which is related technically to those ignition coils.

BACKGROUND ART

Recently, an individual ignition coil type ignition coil for use in an engine has developed such an ignition coil is individually and directly connected to each of the ignition coils which are introduced to plug holes of the engine. In this kind of the ignition coil, a distributor becomes unnecessary, as a result at the distributor and a high tension cord for the distributor etc. a supply energy for the ignition coil does not fall down. In addition to these, without a consideration about a fall down of the ignition energy, it can design the ignition coil. Accordingly, a coil capacity can be made small and a small scale structure of the ignition coil can be devised, and further by an abolishment of the distributor, a rationalization of a component mounting space in an interior portion of an engine room can be devised.

In the above stated individual ignition type ignition coil, so as to mount the ignition coil by introducing at least a part of the ignition coil against to a plug hole, it is called as a plug hole coil. Further, so as to insert a coil portion to the plug hole, the ignition coil is called as a pencil type ignition coil which is long and thin in a pencil shape. This pencil type ignition coil has a center core (a magnetic core in which plurality of silicon steel sheets are laminated), a primary coil and a secondary coil at an interior portion of a long and narrow cylindrical shape coil case. The primary coil and the secondary coil are wounded to a respective bobbin and are arranged concentrically at a periphery of the center core. In the coil case for receiving the primary coil and the secondary coil, by potting and hardening an insulation resin and by filling up an insulation oil, thereby an insulation performance of the ignition coil is guaranteed. As the prior arts, for example, there are Japanese patent laid-open publication No. Hei 8-255719, Japanese patent laid-open publication No. Hei 9-7860, Japanese patent laid-open publication No. Hei 8-97,057, Japanese patent laid-open publication No. Hei 8-144910 and Japanese patent laid-open publication No. Hei 8-203757. Further, in the pencil type ignition coil, there is taken into a consideration in which to restraint the leakage fluxes passing an outer periphery of the coil a side core is provided at the outer periphery of the coil case.

In the pencil type ignition coil, there is two types, one of them in which the primary coil is arranged at an inner side and the secondary coil is arranged at an outer side, and another of them in which the secondary coil is arranged at an inner side and the primary coil is arranged at an outer side. A latter type (a structure of secondary wire is arranged inside primary wire) has an advantage merit about an output characteristic in comparison with a former type (a structure of secondary wire is arranged outside primary wire).

Namely, in case of the pencil type ignition coil in which an insulation resin (for example, an epoxy resin) is potted and hardened to a coil constitution member, as shown in FIG. 7, in the structure in which the secondary wire is arranged outside the primary wire, the primary coil, the epoxy resin, a secondary bobbin, the secondary coil, the epoxy resin, a coil case, and a side core are provided from the inner side in order. In this structure, an electrostatic floating capacitance generates between the secondary coil and the primary coil which is arranged at an inner side of the secondary coil and has a low voltage (this is regarded as a substantial ground voltage), and further an electrostatic floating capacitance generates between the secondary coil and the side core (a ground voltage). As a result, in comparison with the structure in which the secondary wire is arranged inside the primary wire, the electrostatic floating capacitance of the side core follows superfluous, accordingly the electrostatic floating capacitance of the structure in which the secondary wire is arranged outside the primary wire tends to become large. (On the other hand, in the structure in which the secondary wire is arranged inside the primary wire, an electrostatic floating capacitance generates between the secondary coil and the primary coil, and between the primary coil and the side core both the primary coil and the side core has the ground voltages, the electrostatic floating capacitance does not generate substantially).

A secondary voltage output and a secondary voltage rising speed are affected by the electrostatic floating capacitance and the more the electrostatic floating capacity becomes large, the more the output lowers and a delay in the rising generates. As a result, the structure having the small electrostatic floating capacitance in which the secondary wire is arranged inside the primary wire is considered to suit for a small scale structure and a high output performance.

In the case of the structure in which the secondary wire is arranged inside the primary wire, in the structure between the secondary bobbin and the center core, it is an important problem that how an anti-heat shock performance and a mitigation of electric field concentration are compatible with.

The above stated secondary bobbin has a role of an insulation of a high voltage generated in the secondary coil from the center core. In a case where a gap is provided between the secondary bobbin and the center core, a difference in an electric field strength (an electric field strength of a gap portion becomes extremely large, an electric field concentration) generates, a dielectric break down generates at the gap portion between the secondary coil and the center core. To prevent the dielectric break down, it is necessary to fill up an insulation member between the secondary bobbin and the center core and to mitigate the electric field concentration.

However, in the case where the resin is filled up between the secondary bobbin and the center core, according to a difference between the coefficient of linear thermal expansion ($13\times10^{-6}$ mm/° C.) of the center core and the coefficient of linear thermal expansion of the resin, there is an axioms that cracks cause in the resin and the dielectric break down generates. As such a crack prevention countermeasure, it is conceivable that by blending a silica filler etc. the coefficient of linear thermal expansion of the resin approaches to that of the center core. However, in the above case, a flowability of a resin molding lowers and in particularly there is a problem that it is difficult to pot the resin to a gap (one figure level mm at a decimal point) between the center core and the secondary bobbin which is a minute clearance.

Then the inventors of the present invention have devised a method in which a flexible epoxy resin having a glass transition point at less than a normal temperature (20° C.) and young's modulus of $1\times10^{8}$ (Pa) at more than the normal temperature was filled up between the secondary bobbin and the center core. (For example, Japanese patent application No. Hei 7-326800, Japanese patent application No. Hei 8-249733). Herein, the flexible epoxy resin is defined as a soft epoxy resin which has a soft state at the normal temperature. Such a soft epoxy resin is injected, for example, under a vacuum condition to get extremely rid of voids (a vacuum potting type).

The soft epoxy resin has the superior anti-heat shock performance (the heat shock absorption, the heat shock mitigation) against to a repeated thermal stress since the soft epoxy resin has an elasticity. By an employment of the above stated soft epoxy resin, the heat shock against to the center core and the heat shock against to the secondary bobbin can be mitigated and further by an employment of the material having a superior adhesion performance, it can prevent the clearance occurrence between the center core and the secondary bobbin, but on the other hand since an insulation performance is low in comparison with a bobbin material, it is desirable to make thin to the utmost and a thickness of the second bobbin is assured and then the insulation performance between the secondary coil and the center core.

Objects of the present invention are that (1) An object of the present invention is that, in an individual ignition type ignition coil (for example, a plug hole coil) in which the above stated secondary wire being arranged inside the primary wire structure is employed and is led into a plug hole, an anti-heat shock performance and a relaxation of electric field concentration (an insulation performance) between a secondary coil and a center coil can be improved and a quality (a reliability) and a working productivity in manufacturing can be heightened.

(2) Another object is that, even in an engine having a plastic cylinder head cover, an individual ignition type ignition coil can be adopted without any obstacle and a light weight structure of the engine can be realized.

DISCLOSURE OF THE INVENTION

A first invention (an invention relating to claim 1) is that in an individual ignition type ignition coil for use in an engine in which a center core, a secondary coil wound on a secondary bobbin and a primary coil wound on a primary bobbin are installed concentrically from an inner side of a coil case in order, and said ignition coil is connected directly to a respective spark plug of said engine, the ignition coil for use in the engine characterized in that, an insulation resin is filled up between said secondary bobbin and side center core, and a thickness of side secondary bobbin is changed with an inclined shape in such a manner in which an inner diameter of said secondary bobbin is formed larger at a potting side of said insulation resin and is formed small toward for an opposition side of said potting side.

It is necessary to thin to the utmost the insulation resin which is filled up between the secondary bobbin and the center core, for example the soft epoxy resin is used as stated in the above, to secure the secondary bobbin thickness (to secure the insulation performance). Such a secondary bobbin thickness is desirable to secure at the minimum of 0.1 mm to guarantee a linear thermal expansion difference absorption (the heat shock mitigation) against the center core and the secondary bobbin and the absorption in the size scattering in a mass production of a bobbin material and the core and a smoothness of the vacuum potting.

To satisfy the above stated requirements, the gap formed between the secondary bobbin and the center core becomes one having mm (1/10 mm order) of one figure of a decimal point and to this extremely narrow gap the insulation resin is potted and hardened. According to the present invention, to an inner diameter portion of the secondary bobbin, since an inclination having an inner diameter difference in which a potting side is formed large and it becomes smaller toward an opposing side, in the gap formed between the secondary bobbin and the center core, the insulation resin potting side is formed large and it becomes smaller gradually toward the opposing side, accordingly by widening a width of the resin potting and the smoothness of the resin potting can be improved. Further, even the width of the resin potting is widened, the gap between the center core and the secondary bobbin is narrowed gradually, the thin layer structure of the insulation resin can be held to the utmost.

A second invention (an invention relating to claim 2) is that in addition to the above stated first invention, in said secondary bobbin side, a secondary coil low voltage side is a potting side of said insulation resin, said secondary bobbin has an inclination with a difference in inner diameter of said secondary bobbin in such a manner in which an inner diameter of said secondary bobbin is formed large at said secondary coil voltage side and is formed small toward for a secondary coil high voltage side, and said secondary bobbin forms a bobbin structure in which a thickness of said secondary bobbin is formed thin at said secondary coil low voltage side and is formed thick toward for said secondary coil high voltage side.

With this construction, in addition to the operations (a compatibility of the flowability improvement of the insulation resin and the thin layer structure) according to the above stated first invention, next operations are carried out.

A coil portion (a portion comprised of a coil case, a coil accommodated in the coil case, and a core etc.) of the ignition coil is connected directly to a spark plug of a cylinder head and receives a thermal affect of an engine combustion. In a severe operation condition under an outside temperature of 40° C., a second speed 55 km/h at an upslope of 10%, the outer surface temperature of the coil case is 140° C. at a portion where the coil case is connected directly to the ignition coil nearest to the engine, the outer surface temperature is 130° C. at a vicinity of a high voltage side of the secondary coil which is remote just a little from the spark plug, the outer surface temperature is 110° C. at a low voltage side of the secondary coil which is provided at an outer side of the cylinder head and a distance from the secondary coil high voltage side is 80–105 mm degree, and the outer surface temperature is 100° C. at an ignition circuit case which is provided on above the vicinity of the high voltage side.

As a result, in the secondary bobbin it can be expected fully that the secondary coil high voltage side presents a higher temperature condition compared with the secondary coil low voltage side and then the insulation performance lowers and further the thermal stress becomes large. However, according to the present invention, the secondary bobbin thickness at the secondary coil low voltage side is formed thin and the secondary bobbin thickness is formed thick toward the secondary coil high voltage side, with the thickness increase part the insulation performance and the anti-thermal stress at the secondary coil high voltage side is heightened and accordingly it can cope with the above stated thermal affect due to the engine combustion.

A third invention (an invention relating to claim 3) is that, in the secondary wire being arranged inside primary wire structure individual ignition type ignition coil for use in the engine similar to the first and the second inventions, as an insulation resin for potting between said secondary bobbin and center core, said insulation resin is an insulation resin having a glass transition point Tg which satisfy a condition of [an allowable stress of said secondary bobbin> a generation stress (from −40° C. to a glass transition point of said insulation resin)]. The condition establishment reasons of the above stated Tg are as following.

As the above stated insulation resin (herein, the insulation resin is one which is filled up between the secondary bobbin and the center core), to form the thin layer structure and to mitigate to the heat shock (a thermal expansion, a contraction difference according to the temperature change in the engine room; a thermal stress) according to the coefficient of linear thermal expansion difference between the center core and the secondary bobbin, it can cope with to give an elasticity (a flexibility) by softening the resin.

To soften the above stated insulation resin, a glass transporting point Tg and Young's modules after a molding (a thermal hardening) of the resin are important factors. In other words, Tg is a standard as a softening point of the material and more than Tg the resin is softened and the more Young's modulus at the softened condition is small, the more the elasticity (the flexibility) can be carried out.

Accordingly, in a case of the above stated pencil type coil, since the coil is mounted on the engine room having a severe temperature environment (in general, it is −40° C.–130° C.), to obtain the anti-heat shock performance, it is desirable that the above stated insulation resin to have Tg at the low temperature and at the temperature range of the use environment of the engine to have the soft condition to the utmost. However, it is not unnecessary to lower Tg less than −40° C. (in the other words, it is unnecessary to soften the insulation resin until less than −40° C.). The reasons will be explained referring to FIG. 8.

FIG. 8(*a*) is a characteristic view showing behaviors of the insulation resin between the secondary bobbin, and the center core and the secondary bobbin by expecting the temperature of the engine room in which the secondary wire being arranged inside primary wire structure individual ignition type ignition coil to have −40° C. −30° C., and this characteristic has studied clearly by the inventors of the present invention. FIG. 8(*b*) is an explanatory view for compensating the above stated behavior characteristic.

FIG. 8(*b*) shows a condition the secondary bobbin having the secondary wire being arranged inside primary wire structure is contracted to a center core side by accompanying with the lowering of the surrounding temperature, and when the insulation resin between the secondary bobbin and the center core presents the softening condition (more than the glass transition point Tg), since the contraction (the deformation toward the center core side) during the temperature drop is received by the above stated insulation resin, it can admit that the stress (the thermal stress) of the secondary bobbin is not generated substantially.

The engine stops and the temperature drop goes, for example in a cold district, the above stated insulation resin of the pencil type coil becomes less than Tg, the insulation resin transfers to the glass condition and to obstruct the contraction of the secondary bobbin, the stress (the thermal stress) generates on the secondary bobbin. This stress σ is expressed as following in the relationship of Young's modulus E and a strain ϵ.

$$\sigma = E \times \epsilon = E \times \alpha \times T$$

α is the coefficient of linear thermal expansion of the secondary bobbin and T is the temperature change (the temperature difference).

For example, in the temperature change (−40° C.–130° C.) shown in FIG. 8(*a*), in a case where the glass transition point Tg of the insulation resin between the secondary bobbin and the center core is set at 130° C., since the stress of the secondary bobbin generates at a range of 130° C.–−40° C., then the maximum stress $\sigma_{MAX}$ appears. In a case where Tg is set to $Tg_1$, ($Tg_1$<130° C.) a stress $\sigma_1$ generates at a range (a temperature difference $T_1$) of $Tg_1$–−40° C. (at a range of from 130° C. to $Tg_1$, since the contraction of the secondary bobbin is not obstructed, it appears substantially no stress). Similarly to in a case where Tg is set to $Tg_2$, ($Tg_2$>$Tg_1$) a stress $\sigma_2$ generates at a range (a temperature difference $T_2$) of $Tg_2$–−40° C. (at a range of from 130° C. to $Tg_2$, since the contraction of the secondary bobbin is not obstructed, it appears substantially no stress).

For example, in a case where an allowance stress $\sigma_0$ is $\sigma_1<\sigma_0<\sigma_2$, when Tg of the insulation resin between the secondary bobbin and the center core is less than $Tg_1$ (−40° C.<Tg<$Tg_1$), the generation stress σ of the secondary bobbin is small than the allowable stress $\sigma_0$, the generation of the damage of the secondary bobbin can be obstructed. In this case, a range of from −40° C. to $Tg_1$, even the insulation resin between the secondary bobbin and the center core is hardened and the heat shock mitigation operation is out, since the temperature range is narrow, the heat shock weakens the soundness of the secondary bobbin and the center core can be held. Herein, in FIG. 8(*a*), the above stated $Tg_1$ is a position of −25° C., this is one example where the insulation resin is one specified material, however it is not limited to this example.

As stated in the above, the glass transition point which is a boundary point for softening the anti-heat shock performance of the insulation resin, in relationship to the stress generated on the secondary bobbin, is Tg which satisfies a condition [the allowable stress $\sigma_0$ of the secondary bobbin>the generation stress σ of the secondary bobbin at (from −40° C. to the glass transition point of the insulation resin)], the compatibility between the anti-heat shock performance and the soundness of the secondary bobbin against to the secondary bobbin and the center core can be attained. Herein, in the former applications of Japanese patent application No. Hei 7-326800, Japanese patent application No. Hei 8-249733, the elasticity epoxy resin (the insulation resin between the secondary bobbin and the center core) is described that the elasticity epoxy resin is less than a room temperature, however the relationship with the secondary bobbin is not studied.

Further, relating to the above stated third invention, in the above stated secondary bobbin, it proposes that there is a thermoplastic resin having the coefficient of linear thermal expansion $10–45\times10^{-6}$ at the flowability direction and the cross direction during the molding at a range of the normal temperature (20° C.)–150° C. and this insulation resin is the soft epoxy resin having Young's modulus of an elasticity less than $1\times10^{8}$ (Pa) at more than the glass transition point.

A fourth invention is characterized in that the insulation resin (the insulation soft resin) which satisfies the condition of the glass transition point Tg in the third invention is carried out the compression molding between the above stated secondary bobbin and the center core.

With the above stated methods, a volume of the voids which are contained in the resin is contracted to 1/200, and the voidless performance is carried out more, as stated in the above, in the insulation resin (for example, the soft epoxy resin) which is desired to the thin layer structure having one figure level mm at a decimal point, this voidless can devote largely to ensure the insulation performance.

Further, in the secondary bobbin the center core and the magnet are inserted inside toward an axial direction, the above stated soft epoxy resin covers these members and a fixing force at the axial direction of the center core and the magnet is increased by the compression molding and further an anti-vibration performance can be improved.

The compression molding of the insulation resin is carried as a following, for example. Namely after the above stated resin is vacuum potted, under the atmosphere the resin is the thermoplastic resin which is heated and hardened under the atmosphere. The above stated compression molding utilizes the difference pressure in which the vacuum changes to the atmosphere (a correspondence to claim 6).

A fifth invention (an invention relating to claim 5) is that, in the secondary wire being arranged inside primary wire structure individual ignition type ignition coil for use in an engine in which at an upper portion of a coil case a circuit case having a connector is installed inside an ignition unit of the ignition coil, an insulation resin is filled up between said secondary bobbin and said center core and at an upper end opening of said secondary bobbin said insulation resin is carried out a compression molding and a dent is formed at said upper end opening of said secondary bobbin, in said circuit case having said connector, a bottom portion of said circuit case is communicated to an upper portion of said coil case, a molding resin is filled up extending over between from an interior portion of said circuit case having said connector to said secondary coil and said primary bobbin of said coil case and between from said primary coil to said coil case, and said dent formed on said insulation resin is buried by said epoxy resin.

In the secondary wire being arranged inside primary wire structure type individual ignition type ignition coil, the merit (the voidless promotion) for filling up the insulation resin between the secondary bobbin and the center core (for example, the soft epoxy resin) according to the compression molding has stated already in the above.

In the secondary bobbin for accommodating the center core, in a case where the above stated insulation resin is filled up and is carried out the compression molding (for example, in a case where the resin is vacuum potted and the vacuum pressure and the atmosphere pressure after the atmosphere release) by separation other coil elements (the primary bobbin, the coil case, the circuit case on above the coil case, etc.), an earthenware mortar shape dent (a hemisphere shape dent) is left on the insulation resin face which positions an upper end opening face of the secondary bobbin. By the provision of this dent portion of the insulation resin, the concentrated pressing force is acted to the axial direction of the center core, the magnetic vibration etc. Generated in the center core which is constituted by the laminated steel sheets can be restrained effectively, as a result the anti-vibration performance can be improved more. In particularly, in the case where this insulation resin is the soft material, in comparison with the hard material resin the restriction force against to the center core is weakened, to compensate the above it is effective that the above stated dent portion is established to the upper end opening position of the above stated secondary bobbin.

However, in a case where the above stated dent is left, when the case of the ignition circuit is arranged on the coil case upper portion (the coil portion upper portion), since a gap is left between the center core and a metal base in the circuit case, a following inconvenience causes.

Namely, the surrounding portion of the center core is insulated, further the center core receives an affect of the electric field, as shown in FIG. 9, it is considered that the center core has an intermediate potential between the low voltage side and the high voltage side of the secondary coil. For example, in a case where the generation voltage of the secondary coil is about 30 kV, the center core has the intermediate potential of 15 kV. On the other hand, since the metal base which positions at an upper portion of the center core is grounded, when the gap exists between the center core and the metal base, the electric field concentration causes and further the insulation destroy causes.

According to the present invention, since the dent portion (the gap) caused by the compression molding of the insulation resin is buried by the epoxy resin (the epoxy resin which is filled up extending over from the circuit case to the secondary coil, the primary bobbin, and the primary coil, the coil case) which is filled up after the resin fill-up, the above stated electric field concentration can be mitigated widely and as a result the insulation performance between the center core and the metal base can be secured.

Further, the fill-up working of the epoxy resin for burying the above stated dent portion is carried out together with the potting and hardening working of the epoxy resin in which a bottom portion of the circuit case having a connector is communicated to the upper portion of the above stated coil case and extending over between from an interior portion of the circuit case having the connector to the secondary coil and the primary bobbin of the coil case and between the primary coil to the coil case, the rationalization of the working performance can be attained.

Further, in relating to the above stated fifth invention, following matters will propose.

Namely, a sixth invention is that, similarly to the above primary wire being arranged inside primary wire structure individual ignition type ignition coil for use in an engine in which said ignition coil is connected directly to a respective spark plug of said engine, an insulation resin is filled up between said secondary bobbin and said center core, at an upper end opening of said secondary bobbin said insulation resin is carried out a compression molding and a hemisphere dent is formed at said upper end opening of said secondary bobbin, in said circuit case having said connector, a bottom portion of said circuit case is communicated to an upper portion of said coil case, an epoxy resin is filled up extending over between from an interior portion of said circuit case having said connector to said secondary coil and said primary bobbin of said coil case and between said primary coil to said coil case, and said hemisphere shape dent formed on said insulation resin is buried by said molding resin.

With the above stated construction, in addition to the operations and the effects of the fifth invention can be expected, since the dent which is formed at the upper face of the insulation resin positioned at the upper end opening position of the secondary bobbin presents the hemisphere shape, since at the above stated gap (the dent) in which the insulation resin is buried a corner does not exist, even the molding resin is filled up in the dent, the voids are hardly left, as a result the good adhesion performance at the dent boundary face between the insulation resin and the molding resin which is potted in the above can be held.

A seventh invention proposes relating to the above stated ignition coil following engine having a plastic head cover.

Namely, an engine having a plastic head cover, characterized in that a cylinder head of the engine is covered by a plastic head cover; a respective spark plug mounted in said cylinder head is connected directly to an individual ignition type ignition coil which is prepared for each of said spark plug, said individual ignition type ignition coil comprises a coil portion in which a center core, a secondary coil wound on a secondary bobbin and a primary coil wound on a primary bobbin are installed concentrically inside a thin narrow cylindrical shape coil case, and a circuit case having a connector which is provided at an upper portion of said coil case and has an ignition circuit unit inside, said coil portion is penetrated through said plastic head cover and the center of gravity of said ignition coil is positioned at a lower position from said plastic head cover, and said circuit case having said connector is fixed to an outer face of said plastic head cover.

Further, the present invention is able to adopt to irrespective of the secondary wire being arranged inside primary wire structure type and the secondary wire being arranged outside primary wire structure type.

To accompany with the light weight structure of the engine, a need for a plastic structure of a head cover for covering a cylinder head of the engine heightens and to realize this the development has done. As to such a need, in a case where the individual ignition type ignition coil is mounted to a plastic head cover, it is necessary to improve following matters.

For example, in the individual ignition type ignition coil, the ignition coil being used actually is one as shown in FIG. 10. This ignition coil type has a coil portion 150 at an apex portion of a coil main body which comprises the coil portion 150 (a primary coil 153 and a secondary coil 155 are wound to a closed magnetic path core 159) and a rubber boot for combining a plug and this coil portion 150 is installed to a head cover 160 of the engine by means of a screw member 27.

To a plug hole 161 for mounting a spark plug 22, a conductive rod (Al rod) 156 for supplying a high voltage energy to the secondary coil 155, a coil spring member 158 connected to the conductive rod, and a rubber boot 157 for covering these components are mounted inside. And at a lower end of the rubber boot 157 the apex portion side of the spark plug 22 is fitted into and the spark plug 22 is connected to the high voltage side of the secondary coil 155 through the spring 158 and the conductive rod 156. Reference numeral 100 denotes a cylinder head of the engine, 151 denotes a coil case, 151*a* denotes a connector, 152 denotes a primary bobbin and 154 denotes a secondary bobbin.

In a case where the above stated type individual ignition type ignition coil is installed to the plastic engine head cover, since the coil portion is positioned above the head cover and further the center of gravity is positioned above the head cover (the center of gravity is high), the coil portion vibrates together with the engine vibration and acts the swing operation. So that so as far the plastic head cover is formed strongly and increases the rigidity, the head cover itself is not protected and the vibration of the coil portion is not restrained, as a result it is impossible to attain the light weight structure of the head cover (the light weight structure of the engine).

The inventors of the present invention have found out following necessities in which according to the above stated facts a burden of the plastic head cover can make small and to mount the individual ignition coil the center of the gravity of the ignition type ignition coil and further the swing operation is formed small by supporting at least two points of the axial direction of the ignition coil main body.

Under the above stated knowledge, the present invention is constituted, according to the construction, the head cover of the engine is made of the plastic material, in a case where this head cover is installed to the individual ignition type ignition coil, the center of the gravity of the ignition coil is positioned at a low position of the engine head cover, and further the comparative light weight circuit case having the connector in the pencil type coil is fixed (for example, the screw fixing) to the outer face of the plastic head cover, and at this fixing portion and the plug hole combination position of the plug hole two point support mechanism of the axial direction can be obtained. As a result, the vibration of a whole ignition coil is made small and further the vibration of the ignition coil which is given to the plastic head cover can be restrained, the light weight structure (the thin thickness structure) and simplification of the plastic head cover can be attained, and further the mount of the individual ignition type ignition coil can be realized.

BEST MODE FOR CARRYING OUT THE INVENTION

Figure 1:
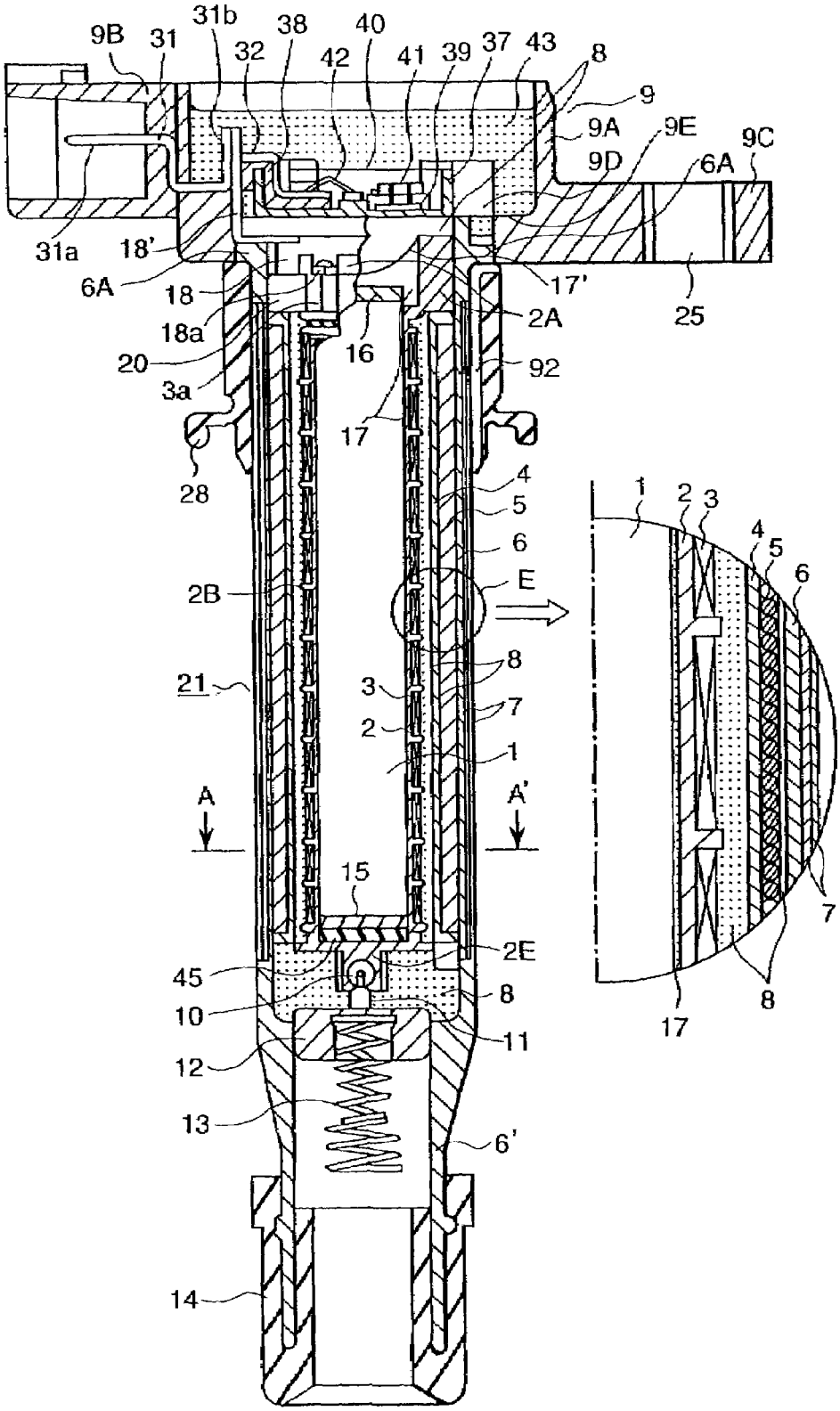
FIG. 1 is a longitudinal cross-sectional view (B—B line cross-sectional view of FIG. 3) of an ignition coil of the first embodiment according to the present invention and E part enlargement cross-sectional view in which a part of the ignition coil is enlarged.

Embodiments according to the present invention will be explained referring to the drawings.

First of all referring to FIG. 1–FIG. 21 a first embodiment of an ignition coil (so called a secondary wire being arranged inside primary wire structure pencil type coil) will be explained.

Figure 2:
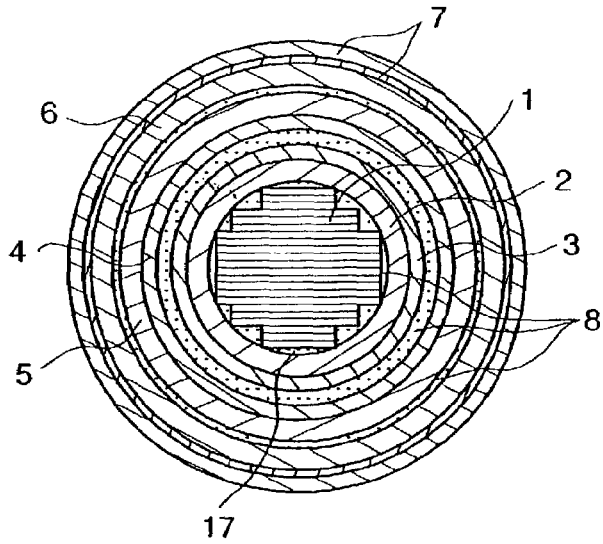
FIG. 2 is A—A line cross-sectional view of FIG. 2.
Figure 3:
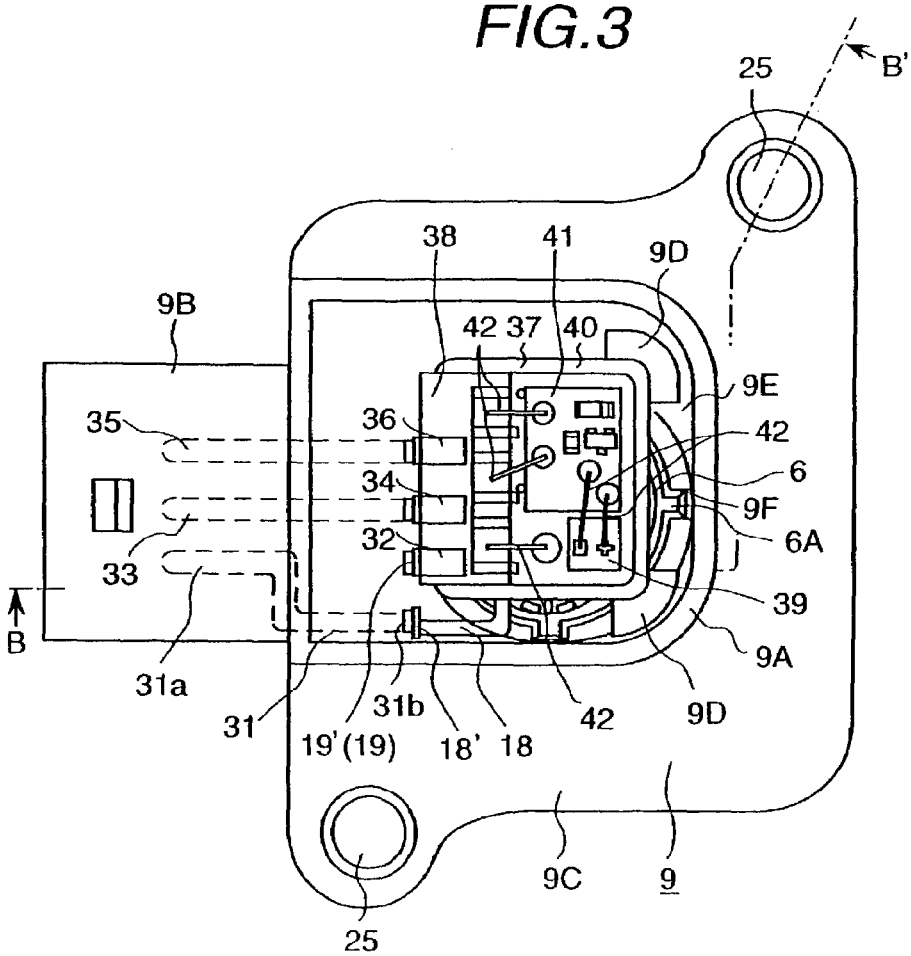
FIG. 3 is a view taken from an upper face of the ignition coil of FIG. 1 and view for expressing a condition before a resin fill-up in an interior portion of a coil case.

FIG. 1 is a longitudinal cross-sectional view (B–B' line cross-sectional arrow viewing view of FIG. 3) of an ignition coil 21 and E portion enlargement cross-sectional view of a part of thereof, FIG. 2 is A–A' line cross-sectional view of FIG. 1. FIG. 3 is a view taken from an upper face of the ignition coil of FIG. 1 and shows an interior portion of a circuit case 9 by expressing a condition of before a resin (silicone gal) fill-up.

In an interior portion of a long and narrow cylindrical shape coil case (an outer case) 6, extending over from a center portion (an inner side) toward an outer side a center core 1, a secondary bobbin 2, a secondary coil 3, a primary bobbin 4, and a primary coil 5 are arranged in order. Further, in the secondary bobbin 2 in a gap between the center core 1 and the secondary bobbin 2, so-called soft epoxy resin (a flexibility epoxy resin) 17 is filled up, and further a gap between the secondary coil 3 and the primary bobbin 4 and a gap between the primary coil 5 and the coil case 6 are filled up with an epoxy resin 8.

The reason why the insulation resin between the center core 1 and the secondary bobbin 2 is constituted by the soft epoxy resin 17 is that, in addition to that a plug hole type and the individual ignition type ignition coil (the pencil type coil) is exposed to a severe environment (a thermal stress of −40° C.–130° C. degree), as stated in the above a difference between the coefficient of the thermal expansion ($13\times10^{-6}$ mm/° C.) of the center core 1 and the coefficient of the thermal expansion ($40\times10^{-6}$ mm/° C.) of the epoxy resin is large. In a case where an ordinary insulation epoxy resin (an epoxy resin composition harder than the soft epoxy resin 17) is used, there is an anxious that cracks cause in the epoxy resin due to the above stated heat shock and the insulation destroy generates. In other words, to cope with the above stated anti-heat shock, the soft epoxy resin 17 which is a superior elasticity body for the heat shock absorption and has the insulation performance is used.

The composition of this soft epoxy resin 17 is, for example, a mixture material of an epoxy resin and an aliphatic polyamine (a mixture rate is the epoxy resin 100 wt %, the aliphatic polyamine 100 wt % in a weight ratio of 1:1) and a potting process is as follows.

Taking up one example, after the center core 1 has inserted into the secondary bobbin 2, these components are laid in a vacuum chamber and evacuating (for example 4 Torr) the chamber and under this vacuum condition the soft epoxy resin 17 is potted with a liquid state and filled up between the secondary bobbin 2 and the center core 1, after that under the atmosphere and 120° C., they are heated 1.5–2 hours and are hardened.

With the above stated processes, during the heating and hardening since the soft epoxy resin 17 which was potted under the vacuum condition they are laid under the atmosphere, during the heating and the hardening the soft epoxy resin 17 between the secondary bobbin 2 and the center core 1 is carried out the compression molding (a compression transformation) according to the difference in pressure between the atmospheric pressure and the vacuum pressure.

Since the soft epoxy resin 17 is carried out to the compression molding, the void volume contained in the resin is contracted to 1/200 and the voidless performance can be obtained more. The size of the void not for generating the discharge is less than 0.5 mm in a case where an insulation layer between the discharge terminals is 1.0 mm, the more the insulation layer is thin, it is necessary to make small the size of the void not for generating the above stated discharge, therefore the compression molding is effective.

Figure 6:
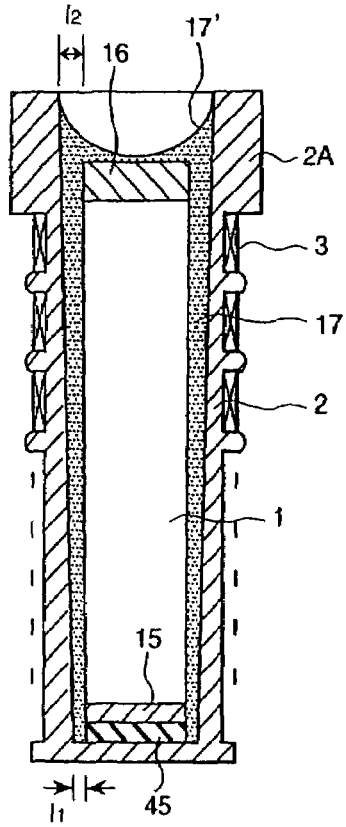
FIG. 6 is a cross-sectional view showing an interior construction of a secondary bobbin which accommodates a center core is shown schematically.

FIG. 6 is a view expressed by taking out the secondary bobbin 2 in which among the above stated coil elements the above stated soft epoxy resin 17 is filled up and by longitudinal crossing an interior portion thereof (in FIG. 6, the construction between the center core 1 and the secondary bobbin 2 is described with an exaggeration for making clear the characteristic point in figure).

As shown in FIG. 6, as to the soft epoxy resin 17 which is filled up in the secondary bobbin 2, giving a full account, the resin is filled up extending over from between the center core 1 and the secondary bobbin 2 to an upper end opening of the secondary bobbin 2, in the case where utilizing the difference in pressure of the above stated atmospheric pressure and the vacuum pressure the compression molding is carried out, an earthenware mortar shape (a hemispheric shape) curve face dent 17' (for example, a depth of about 3–5 mm degree) is left on a surface of the soft epoxy resin which is positioned at the upper end opening position of the secondary bobbin 2. This dent 17' is formed by denting a central portion of an opening end of the secondary bobbin 2 and a surrounding portion thereof is formed to the earthenware mortar shape by holding the condition leaving it intact according to a surface tensile force.

Since only to the secondary bobbin 2 in which the soft epoxy resin 17 is individually filled up, the dent 17' is generated on the surface of the resin 17 at the opening side of the secondary bobbin 2. By the dented portion 17' of the soft epoxy resin 17, the pressing force which is concentrated to the axial direction of the center core 1 acts and the magnetic vibration etc. which is caused the center core 1 constituted by the laminated steel sheets is restrained effectively, as a result the anti-vibration performance can be improved more. However, in a case where the dent 17' is left as it is, when the ignition circuit case 9 (confer FIG. 1) of is arranged on an upper portion of the coil case (a coil portion upper portion), a gap is left between the center core 1 and the metal base 37 in the ignition circuit case 9 and following inconveniences will cause.

Figure 9:
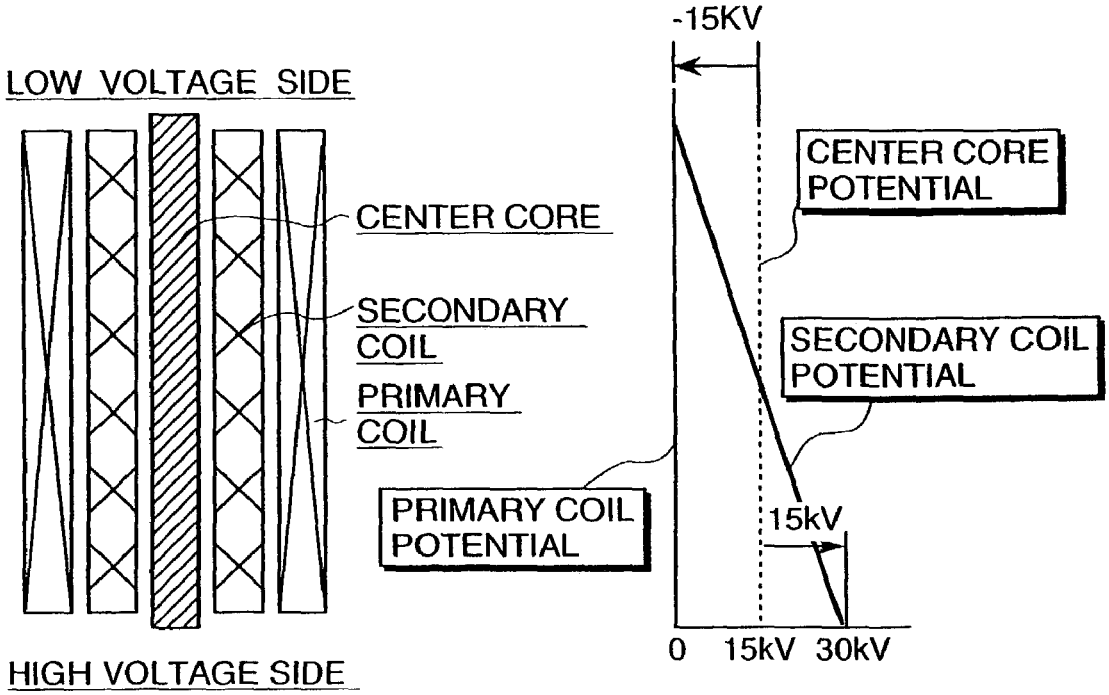
FIG. 9 is an explanatory view showing the potentials of the secondary bobbin and the center core.
Figure 10:
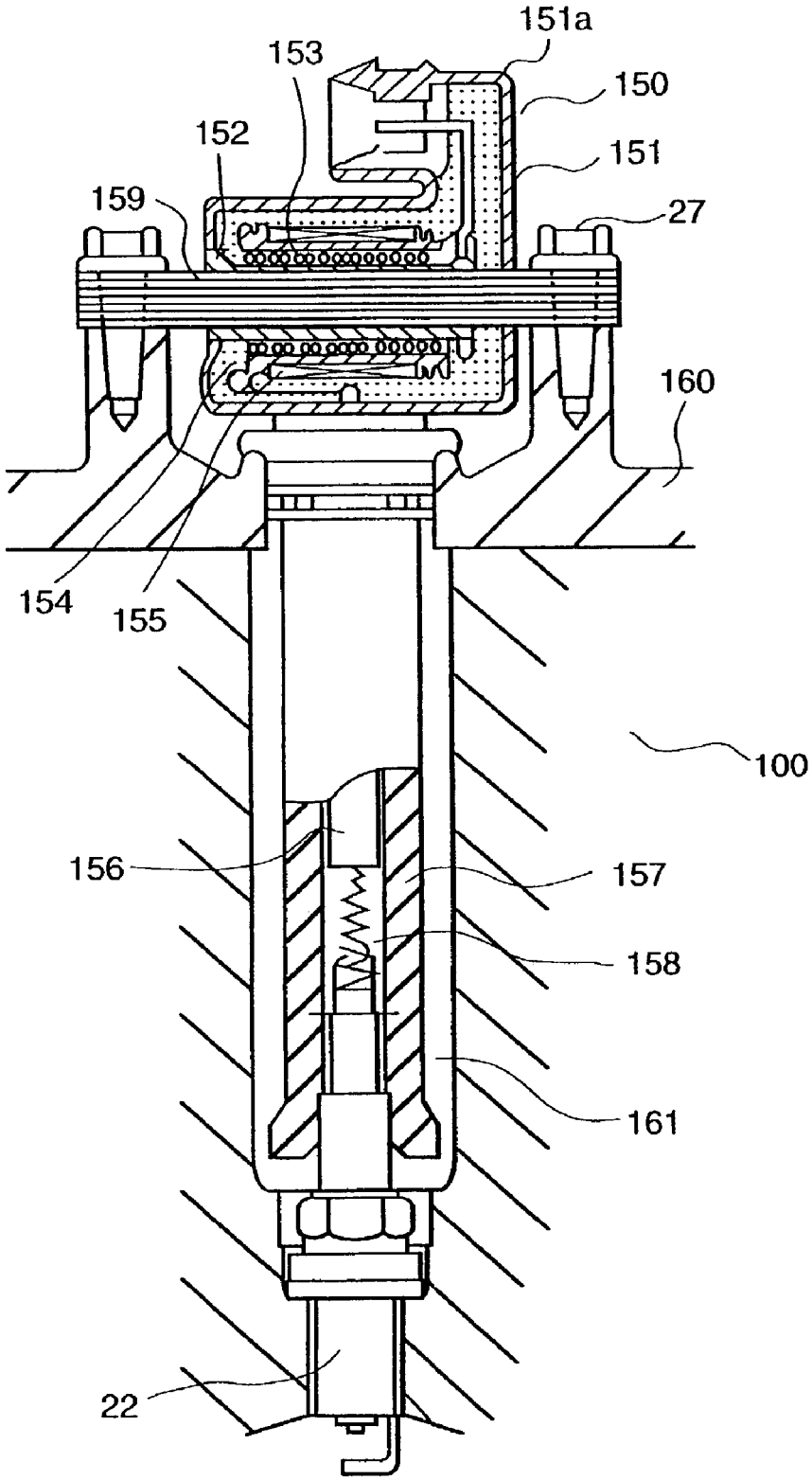
FIG. 10 is a view showing an actual mounting condition of a prior art type individual ignition type ignition coil.

In a case where the center core 1 insulated, as stated using FIG. 9, it is considered that the center core 1 has an intermediate potential (for example, in a case where the generation voltage of the secondary coil is about 30 kV, the center core has the intermediate potential of 15 kV). On the other hand, since the metal base 37 which is positioned at an upper portion of the center core 1 is grounded, when the gap exists at the center core 1 and the metal base 37, the electric field concentration causes and further the insulation destroy generates.

In this embodiment, since the dent portion (the gap) caused by the compression molding of the above stated soft epoxy resin 17 is buried by an epoxy resin 8 which has higher insulation performance than the soft epoxy resin, the above stated electric field concentration can be mitigated widely and a result the insulation performance between the center core 1 and the metal base 37 can be secured.

In particularly, since the dent 17' which is formed at the upper face of the insulation resin 17 presents the hemispheric shape, at the dent 17' buried by the epoxy resin (the molding resin) 8 a corner does not exist, even the molding resin 8 is filled up in this dent 17', the voids are hardly left, as a result the good adhesion performance at the dent boundary face between the soft epoxy resin 17 and the epoxy resin which is potted in the above can be held. The boundary face (the hemispheric shape dent 17' face) between this epoxy resin 8 and the soft epoxy resin 17 has the good adhesion performance because that both are epoxy systems.

By the way, the insulation performance (the destroy voltage) of the soft epoxy resin 17 used in this embodiment is changed by the temperature (in company with the temperature rise, the insulation performance lowers), however it is 10–16 kV/mm and that of the epoxy resin 8 is 16–20 kV/mm.

The soft epoxy resin 17 has the glass transition point Tg which satisfies a condition [the allowable stress $\sigma_0$ of the secondary bobbin 2>the generation stress $\sigma$ of the secondary bobbin at (from −40° C. to the glass transition point Tg of the soft epoxy resin 17)]. Herein, as one example, as the soft epoxy resin 17, the glass transition point is exemplified −25° C. and this corresponds to $Tg_1$ shown in FIG. 8.

Figure 8:
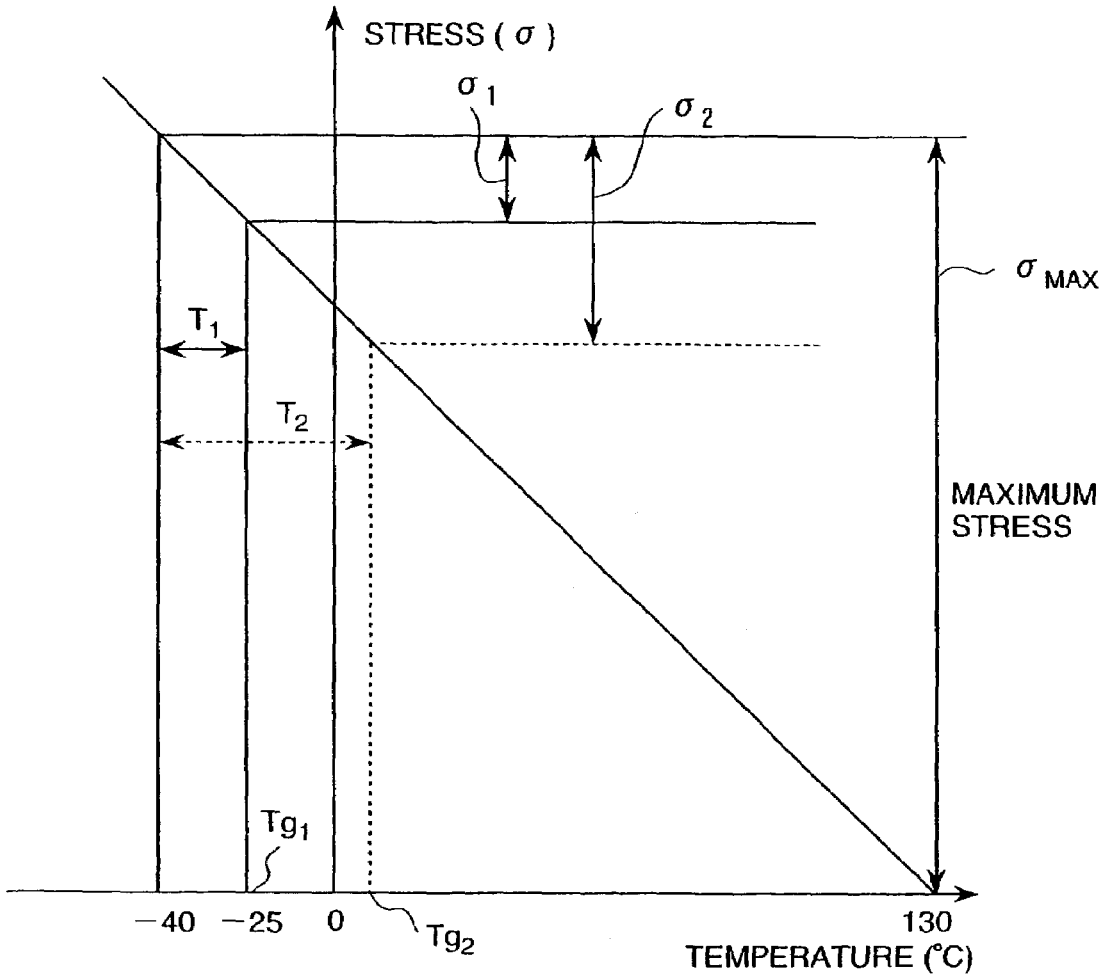
FIG. 8 is an explanatory view showing a relationship between a stress of the secondary bobbin and a glass transition point of a soft epoxy resin.
Figure 8:
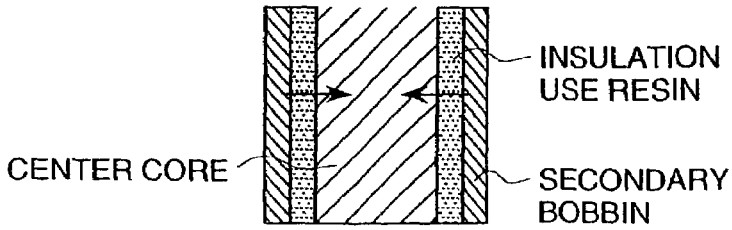

As explained already using FIG. 8, in a case where the glass transition point of the soft epoxy resin 17 is $Tg_1$, the secondary bobbin 2 is laid in the environment in which the temperature changes from 130° C. to −40° C. and is contracted according to the temperature drop after the operation stop, at a range of from 130° C. to $Tg_1$, since the contraction of the secondary bobbin 2 is received by the soft epoxy resin 17, in the secondary bobbin 2 there is substantially no stress. At a temperature range of from $Tg_1$, to 40° C., the soft epoxy resin 17 is transferred to the glass condition and since the contraction of the secondary bobbin 2 is obstructed, the thermal stress generates in the secondary bobbin 2. However, the allowable stress $\sigma_0$ of the secondary bobbin 2 is larger than the generation stress $\sigma_1$ ($\sigma_1<\sigma_0$), the secondary bobbin 2 does not destroy.

In this embodiment, the secondary bobbin 2 is a thermoplastic resin having the coefficient of linear thermal expansion $10–45\times10^{-6}$ at the flowability direction and the cross direction during the molding at a range of the normal temperature (20° C.) −150° C. and this soft epoxy resin 17 has Young's modulus of an elasticity of less than $1\times10^8$ (Pa) at more than the glass transition point of −25° C. Under these conditions, the temperature change of 130° C.–40° C. is given repeatedly and when the inventors have observed the secondary bobbin 2, the damage does not generate on the secondary bobbin 2 and have confirmed that the soundness is maintained. In other words, under the above stated conditions, the inventors have confirmed that the allowable stress $\sigma_0$ is larger than the generation stress of $\sigma_1$.

Next, the epoxy resin 8 is filled up with a following manner.

As shown in FIG. 1, in the circuit case 9 having the connector which is connected to the coil case 6, a bottom portion 9E thereof is communicated with the upper portion of the coil case 6 and from the interior portion of the above stated circuit case 9 having the connector extending over between the secondary coil 3 and the primary bobbin 4 of the coil case 6 and between the primary coil 5 and the coil case 6, the epoxy resin 8 is vacuum potted and at the atmospheric pressure the resin is heated and hardened.

The insulation performance between the secondary coil 3 and the primary bobbin 4 and between the primary coil 5 and the coil case 6 is ensured by the epoxy resin 8. The epoxy resin 17 as stated already is the soft material (the flexibility) epoxy and the epoxy resin 8 filled up above the resin is harder than the soft epoxy resin 17.

In the epoxy resin 8, to improve the anti-thermal stress (the repeating stress of −40° C. and 130° C.) and the anti-high voltage characteristic under the high temperature, the material is constituted that the silica powders and molten glass powders are mixed 50%–70% in a total and after the hardening the glass transition point is 120° C.–140° C., and the coefficient of linear thermal expansion of the range of the normal temperature (20° C.)—the glass transition point is a range of $18–30\times10^{-6}$, and further similarly to the primary bobbin 4 and the secondary bobbin 2, the difference in the coefficient of linear thermal expansion to the metal of the coil portion is made small to the utmost. In the epoxy resin 8 having less than 0.3 mm, since the cracks generate according to the thermal strain, from an aspect of a mechanical strength, it is necessary to employ the epoxy resin 8 having the thickness of more than 0.4 mm. Further, to hold the anti-voltage performance having 30 kV degree, it is necessary to employ the thickness 0.9 mm degree, and in this embodiment the layer thickness of the insulation epoxy resin 8 between the secondary coil 3 and the primary bobbin 4 is formed 0.9–1.05 (mm) degree.

Further, as to the epoxy resin 8 which is filled up between the primary coil 5 and the coil case 6, since the anti-voltage performance is not required and the crack generation is permitted, the layer thickness of less than 0.4 mm can be allowed, in this embodiment the layer thickness is 0.15–0.25 mm degree.

As stated in the above, the dent 17' of the soft epoxy resin 17 is buried by the epoxy resin 8.

The secondary bobbin 2 is arranged between the center core 1 and the secondary coil 3 and further works a role for insulation the high voltage which is generated in the secondary coil 3. The material for the secondary bobbin 2 is made of a thermoplastic resin comprised of a polyfphenylene sulfide (PPS) and a modified polyphenyene oxide (a modified PPO), etc.

Under the restriction of the small size structure (the narrow diameter structure) of the ignition coil, as far as to obtain the large of the occupied area of the center core 1 or to obtain the output-up, it is necessary to select the resin which is able to mold to the bobbin material having the thin thickness. PPS has following characteristics that a good flowability during the molding among the thermoplastic synthetic resins and even the blending amount of the inorganic powders is more than 50 wt %, the flowability does not damage and the thin thickness structure is obtained effectively. In a case where PPS is used for the secondary bobbin 2, to make to approach the difference in the coefficient of linear thermal expansion to the metal of the coil portion as possible, the inorganic powders comprised of the glass fibbers and the tarc etc. is mixed 50–70 wt % (in this specification, PPS may be called as a high filler PPS), and the coefficient of linear thermal expansion at a range of the normal temperature (20° C.)–150° C. is $10–45\times10^{-6}$ during the molding including the flowability direction and the cross direction.

As to the thickness of the secondary bobbin 2, in a case where PPS having the above stated composition is used, since Young's modulus is twice of that of the modified PPO, to satisfy the mechanical strength, the thickness can be less than ½ of the modified PPO, as a result the thin thickness structure of the bobbin can be attained.

The insulation layer between the secondary coil 3 and the center core 1 is constituted by the soft epoxy resin 17 and the secondary bobbin 2, the thickness of this insulation layer is set taking into under following considerations.

Since the soft epoxy resin 17 has the low insulation performance in comparison with that of the bobbin material, the thickness of the resin may be made thin to the utmost and it is desirable to increase the thickness of the secondary bobbin 2 having the high insulation performance. To absorb the difference in the coefficient of linear thermal expansion against the center core 1 and further to form small the size scattering of the mass production of the bobbin material and the core and to also ensure the smoothness of the voidless vacuum potting type, it is necessary to form the thickness of the resin 0.1 mm at the maximum. For example, the thickness of the resin is made 0.1–0.15±0.05 (mm).

On the other hand, as to the thickness of the secondary bobbin 2, in a case where the bobbin material is PPS, it is necessary to have more than 0.5 mm from the aspects of the molding performance and the mechanical strength (the strength in which the cracks do not occur against the thermal stress (the thermal strain)). Further, from the aspect of the insulation performance, the necessary thickness for the secondary bobbin 2 is as following.

As shown in FIG. 9, for example in a case where the generation voltage of the secondary coil 3 is 30 kV (the high voltage side voltage), since the center core 1 is not grounded, the intermediate voltage is considered as 30/2=15 kV. Viewing from the center core 1 to the low voltage side of the secondary coil 3, there is a potential difference of −15 kV, and viewing from the center core 1 to the high voltage side of the secondary coil 3, there is a potential difference of +15 kV. As a result, it is considered that it is desirable to have about 15 kV as the anti-voltage of the secondary bobbin. On the other hand, in the case where PPS is used as the bobbin material, the insulation performance is 20 kV/mm degree, to withstand the above stated voltage of 15 kV, the thickness becomes more than 0.75 mm.

The anti-voltage of the secondary bobbin 2 is various ones according to the output of the secondary coil 3, in this embodiment, taking into the output voltage of the secondary coil 3 as the range of 25–40 kV, under the condition in range in which the requirement of the anti-voltage [(the output voltage)/2 of the secondary coil] is satisfied, it is determined in a range of 0.5–1.0 mm.

Further, Young's modulus of the high filler PPS is twice of that of the modified PPO. As a result, as the material of the secondary bobbin 2, in a case where the modified PPO is employed in place of the above stated high filler PPS, to satisfy the mechanical strength, it is necessary to make the thickness more than twice of the high filler PPS and it is necessary to have more than 1.0 mm. The insulation performance of the modified PPO is 16–20 kV/mm.

In other words, viewing from the aspect of the mechanical strength, in the case where the high filler PPS is used to the secondary bobbin 2, the thickness can be ½ thickness in comparison with that of the modified Further, as to the thickness of the secondary bobbin 2, it is not uniformly. The bobbin structure constitutes that the secondary bobbin 2 has the bottom portion and by opening the low voltage side of the secondary bobbin a potting side of the insulation resin is formed. Further, in the secondary bobbin 2, as shown in FIG. 6, in the inner diameter portion the inclination is provided, such an inclination has difference in the inner diameter which is large to the low voltage side of the secondary coil and to make small toward the high voltage side of the secondary coil. The secondary coil thickness at the low voltage side of the secondary coil is thin and the secondary bobbin thickness is thick toward the high voltage side of the secondary coil.

FIG. 6 has the exaggeration part in figure to understand easily the inclination of the thickness of the above stated secondary bobbin 2. The size is that in a case where an outer diameter of the secondary bobbin is 10–12 mm, the secondary bobbin thickness at the soft epoxy resin potting side (the low voltage side of the secondary coil) is 0.75±0.1 (mm), the opposing side (the high voltage side of the secondary coil) of the resin potting side is 0.9±0.1 (mm).

The specification of the thickness of the secondary bobbin 2 is set as the above, so that the ignition coil has following merits.

Namely, with respect to the gap of the soft epoxy resin 17 which is filled up between the secondary bobbin 2 and the center core 1, as stated in the above it is desirable to make thin as possible from the requirement for the ensure of the thickness of the secondary bobbin 2 and the maximum gap is 0.1–0.15±0.05 (mm) degree. This gap is supposed as a gap $\mathbf{1}_1$ between the secondary bobbin and the center core at the opposing side of the soft epoxy resin potting side, a gap $\mathbf{1}_2$ between the secondary bobbin and the center core at the soft epoxy resin potting side is 0.2–0.4 (mm) by the provision of the thickness inclination of the above stated secondary bobbin. As a result, by spreading the width of the potting the smoothness of the resin potting can be attained, further even by spreading the width of the potting the gap between the center core 1 and the secondary bobbin 2 gets narrow gradually, accordingly the thin layer structure of the soft epoxy resin 17 can be held to the utmost.

Figure 5:
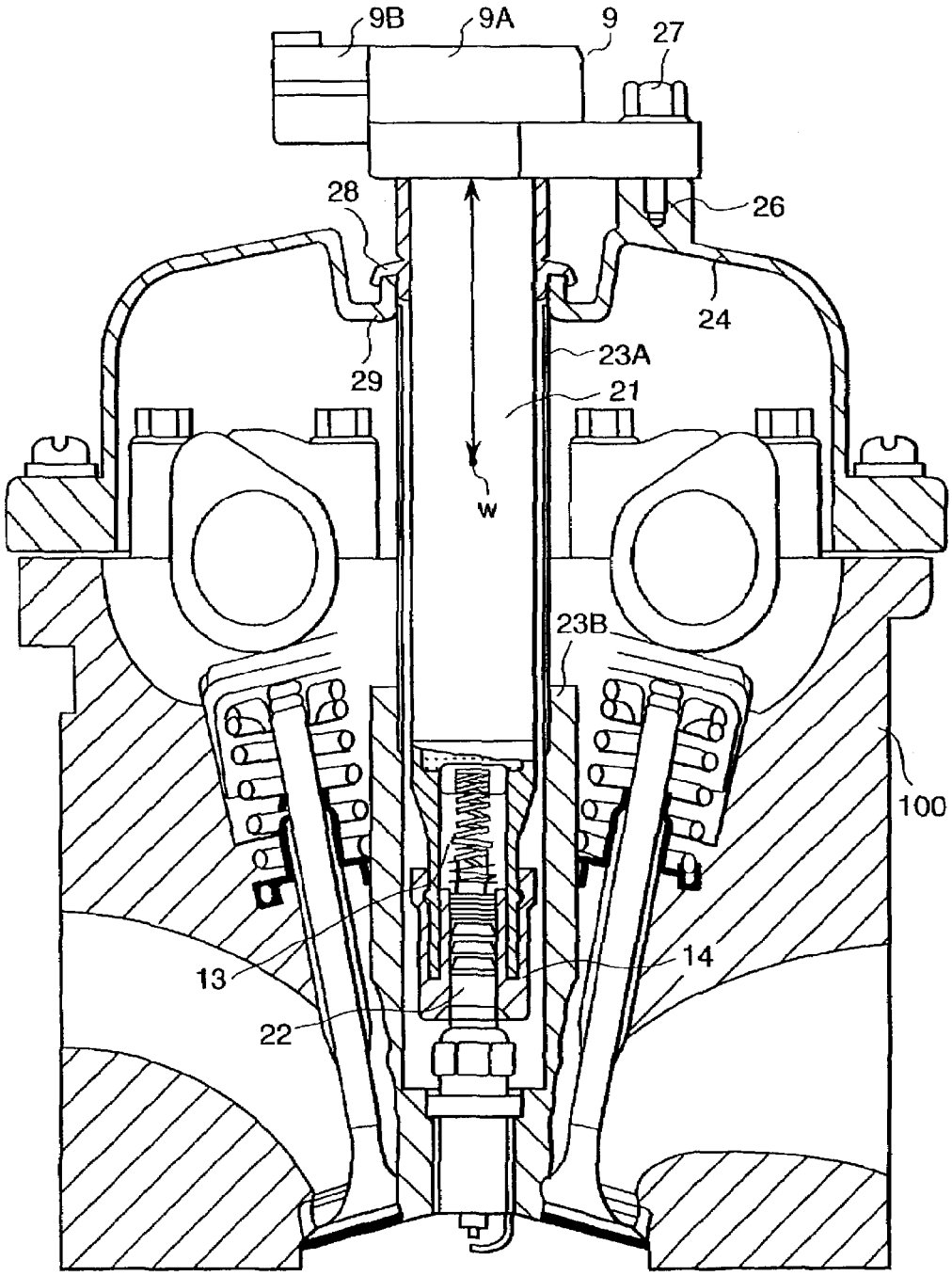
FIG. 5 is an explanatory view showing a condition in which the ignition coil according to the present invention is installed to an engine.
Figure 7:
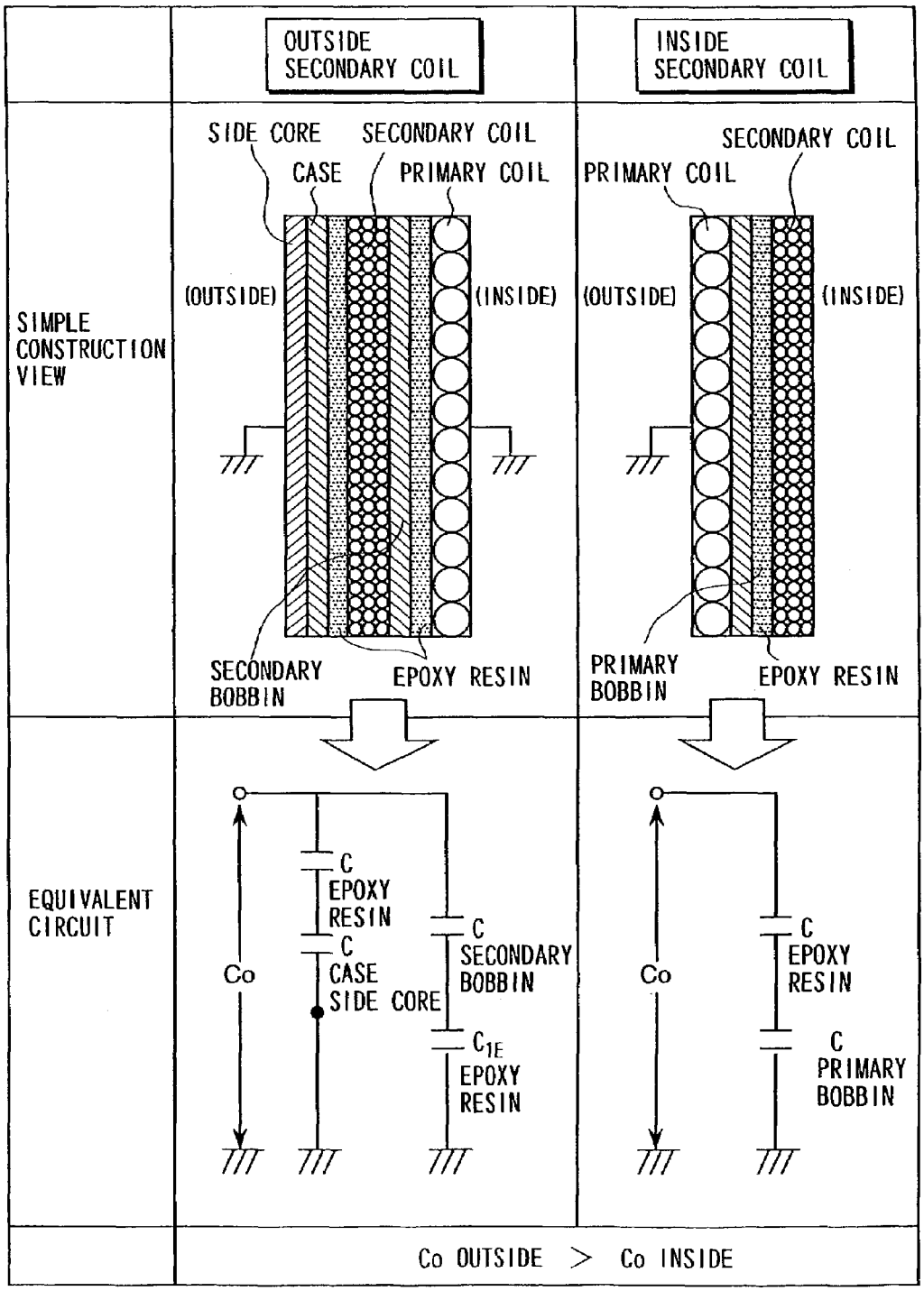
FIG. 7 is an explanatory view showing a generation mechanism of an electrostatic floating capacity of the ignition coil.

Further, the coil portion (the portion comprised of the coil case 6, the coil which are accommodated in the coil case, the core etc.) of the ignition coil, as shown in FIG. 5, since the high voltage side of the secondary coil is connected directly to the spark plug 22 of the cylinder head 100, the thermal affect by the engine combustion receives easily directly (the outer surface temperature of the coil case 6, as stated in the above. In the severe operation condition, at the portion which is connected directly to the spark plug 22, the outer surface temperature is 140° C., the vicinity of the high voltage side of the secondary coil, the outer surface temperature is 130° C., the vicinity of the low voltage side of the secondary coil, the outer surface temperature is 110° C., because it exists at the outer side of the cylinder head and the distance between the low voltage side of the secondary coil and the high voltage side of the secondary coil is 80–150 mm degree, and the ignition circuit case above it is 100° C. degree).

As a result, it will be expected fully that among the secondary bobbin 2 the high voltage side of the secondary side becomes the higher temperature condition than that of the low voltage side of the secondary side and the insulation performance lowers (for example, in the case of PPS for forming the material of the secondary bobbin 2, the anti-voltage (the destroy voltage) is 20 kV/mm at the normal temperature (20° C.), 18 kV/mm at 100° C., and 17 kV/mm at 120° C.), and further the thermal stress becomes large. However, in this embodiment, since the secondary bobbin thickness of the low voltage side of the secondary coil is made thin and the secondary coil thickness is made thick toward for the high voltage side of the secondary coil, with the thickness increase part the insulation performance and the anti-thermal stress of the secondary coil high voltage side can be heightened and as a result it can cope with the thermal affect of the above stated engine combustion.

The secondary coil 3 which is wounded on the secondary bobbin 2 has wound 5000–20000 turns degree using an enamel wire having a wire diameter of 0.03–0.1 mm degree. The structures of the secondary bobbin 2 and the primary bobbin 4 and a bobbin assembling (a coil assembling) will be explained in detail at a latter portion referring to FIG. 1–FIG. 3 and FIG. 11–FIG. 21.

An outer diameter of the secondary bobbin 2 to which the secondary coil 3 is wound is formed smaller than the inner diameter of the primary bobbin 4, and the secondary bobbin 2 and the secondary coil 3 are positioned at an inner side of the primary bobbin 4.

Similarly to the secondary bobbin 2, the primary bobbin 4 is molded using the thermoplastic synthetic resin such as PPS, the modified PPO, polypbuthlene terephthalate (PBT) etc. and the primary coil 5 is wound on the primary bobbin 4. In a case of the employment of PPS, as stated already, it is possible to mold the thin thickness and the thickness of the primary bobbin is 0.5 mm–1.5 mm degree. Further, the inorganic powders comprised of the glass fibers and the tarc is mixed with more than 50–70 wt % and the difference in the coefficient of linear thermal expansion to the metal in the coil is lessened to the utmost.

The primary coil 5 is wound 100–300 turns degree in a total extending over several layers in which one layer is several ten turns using the enamel wire having the wire diameter of 0.3–1.0 mm. Further, in E portion enlargement cross-sectional view of FIG. 1 from the convenience in figure, the primary coil 5 is expressed schematically with one layer, however the primary coil 5 is constituted with the above stated several layers.

The coil case 6 is transformed by a mixture resin, for example it is molded using the thermoplastic resin such as PPS, the modified PPO, PBT, etc. or using a mixture resin in which the modified PPO about 20% is blended to PPS as a blending agent (the mixture manner of the see-island structure, the see structure is PPS and the island structure is the modified PPO).

Among the above, the coil case 6 in which the modified PPO is mixed with PPS as the blending agent has the good adhesion performance against the epoxy resin 8 and has the superior anti-voltage performance and has the superior water proof performance and the superior anti-thermal performance (PPS is superior in the anti-thermal performance, the anti-voltage performance and the water proof performance, however PPS in singly has the inferior adhesion performance to the epoxy resin, to compensate the above, by blending the modified PPO which PPO which has the good adhesion performance to the epoxy resin, the adhesion performance can be improved). The thickness of the coil case 6 is 0.5–0.8 mm degree.

Further, to the thermoplastic resin for forming the coil case 6, similarly to the bobbin material, to make small as possible the difference in the coefficient of linear thermal expansion, the inorganic powders comprised of the glass fibers and the tarc are blended suitably. The circuit case having the connector 9B arranged above the coil case (it is called as an ignition control unit case or as an igniter case) is molded separately with the coil case 6 and is formed with PBT or the similar material of the coil case 6.

The epoxy resin 8 is potted into between the secondary coil 3 and the primary bobbin 4 and also between the primary coil 5 and the coil case 6 and as a result the insulation performance can be ensured.

In the epoxy resin 8, to improve the anti-thermal stress (the repeating stress of −40° C. and 130° C.) and the anti-high voltage characteristic under the high temperature, the material is constituted that the silica powders and the melting glass powders are mixed 50%–70% in total and after the hardening the glass transition point is 120° C.–140° C., and the coefficient of linear thermal expansion of the range of the normal temperature (20° C.)—the glass transition point is a range of $18–30\times10^{-6}$, similarly to the primary bobbin 4 and the secondary bobbin 2, the difference in the coefficient of linear thermal expansion to the metal of the coil portion is made small to the utmost. In the epoxy resin 8 having the thickness of less than 0.3 mm, since the cracks generate according to the thermal strain, from an aspect of a mechanical strength, it is necessary to employ the epoxy resin 8 having the thickness of more than 0.4 mm. Further, to hold the anti-voltage performance having 30 kV degree, it is necessary to employ the thickness 0.9 mm degree, and in this embodiment the layer thickness of the insulation epoxy resin 8 between the secondary coil 3 and the primary bobbin 4 is formed 0.9–1.05 (mm) degree.

Further, since the epoxy resin 8 which is filled up between the primary coil 5 and the coil case 6 is not required the anti-voltage performance and the crack generation is permitted, the layer thickness of the resin can be less than 0.4 mm, in this embodiment the layer thickness of the resin is 0.15–0.25 mm degree.

The circuit case 9 accommodates a unit 40 of a drive circuit (an ignition circuit) for the ignition control and is molded integrally with the connector portion (the connector housing) 9B. The circuit case 9 and the connector terminals etc. are described in a latter portion.

As to increase the cross-sectional area of the center core 1, the center core 1, for example as shown in FIG. 2, plurality silicon steel sheets or plurality grain oriented magnetic steel sheets in which width lengths are set several stages and having a thickness of 0.3–0.5 mm is performed with a pressing laminated structure and this center core 1 is inserted into the inner diameter portion of the secondary bobbin 2.

The side core 7 which is mounted on an outer side face of the coil case 6 constitutes the magnetic paths by cooperating with the center core 1 and is formed by rounding in a pipe form using the thin silicon steel sheets or the grain oriented magnetic steel sheets having a thickness of 0.3–0.5 mm degree. To prevent one turn short of the magnetic flux, the side core 7 is provided at least one notch portion at the axial direction in a circumferential portion of the side core 7. In this embodiment, in the side core 7, by overlapping plural silicon steel sheets (in this example, two sheets) the eddy current loss is decrease and the output improvement is obtained. However, it is possible to constitute using one sheet silicon steel sheet or more than two sheet silicon steel sheets and it can be set suitably by complying with the material (aluminum, iron, etc.) of the plug hole etc.

With respect to the coil portion of the pencil type coil of this embodiment, for example an outer diameter of the coil case 6 is 22–24 mm degree and an area of the center core 1 is 50–80 $mm^2$ degree, a length (a bobbin length) of the coil portion is 86–100 mm degree, an outer diameter of the secondary bobbin is 10–20 mm degree and an outer diameter of the primary bobbin is 16–18 mm degree. With the above stated specifications, the layer thickness etc. of the constitution elements of the above stated coil portion are determined. Further, in this embodiment, in the thickness of the primary bobbin 4 and the coil case 6, a thickness difference of 0.15 mm degree is provided to form thin the resin potting side and to form thick the opposing side against to the resin potting side.

At the outer periphery of the secondary bobbin 2, many flanges 2B for divisional winding of the secondary coil 2 are arranged by laying a predetermined interval at the axial direction.

At the upper portion of the secondary bobbin 2, a bobbin head 2A is molded integrally with the secondary bobbin 2. The bobbin head 2A is set to project from the upper end of the primary bobbin 4.

Figure 12:
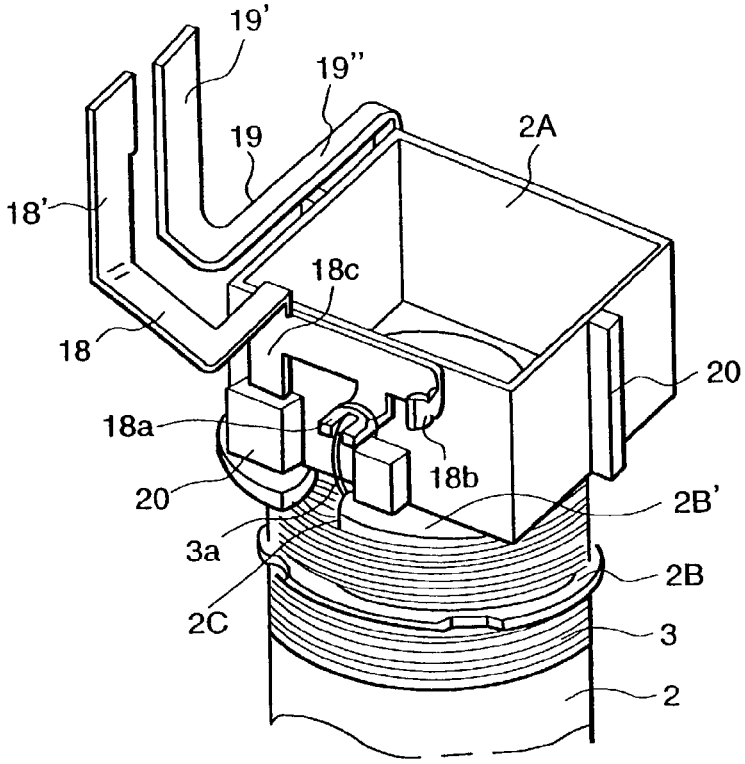
FIG. 12 is a partial squint view showing the secondary bobbin for use in the first embodiment.
Figure 13:
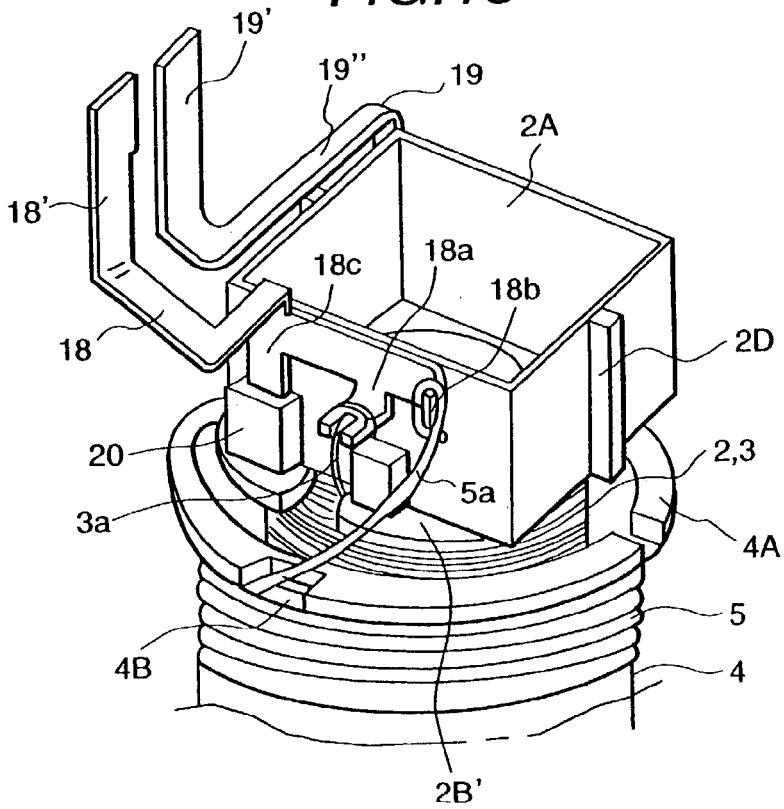
FIG. 13 is a partial squint view showing an assemble condition of a primary bobbin and the secondary bobbin for use in the first embodiment.

FIG. 12 is an enlargement squint view showing a vicinity of the bobbin head 2A after the process in which the secondary coil 3 is wound on secondary bobbin 2, and FIG. 13 is an enlargement squint view showing a vicinity of the bobbin head 2A in a case where the secondary bobbin 2 shown in FIG. 12 is inserted into the primary bobbin 4. Further, in FIG. 1, the bobbin head 2A is carried out a partial cross-section and a non-cross section part indicates a part of the outer side face of the bobbin head.

The bobbin head 2A of this embodiment forms a rectangular box shape and to the outer side face of the bobbin head 2A an engagement portion 2D for engaging with a detent member 64 during the manufacturing process of the ignition coil the secondary bobbin 2 is inserted and set to a rotating shaft 62 (confer FIG. 20) of a winding machine, such a detent member serves as a bobbin positioning member which is provided at a side of the rotating shaft.

The engagement portion 2D in this embodiment has a projecting stripe which extends over the bobbin axial direction and the detent member 64 of at a side of the rotating shaft 62 provides two pins 64 in parallel to the axial direction of the shaft 62 at one end face of a coupling 63, between these pins 64 the projecting stripe engagement portion 2D is fitted into.

To the interior portion of the bobbin head 2A, through the upper portion opening portion the magnets 16, as shown in FIG. 1, the soft epoxy resin 17 is filled up. Further, regardless of the side of the secondary bobbin 2, to the outer side face of the bobbin head 2A a coil terminal 18 which serves as the primary coil and the secondary coil an a primary coil 19 are provided.

Figure 11:
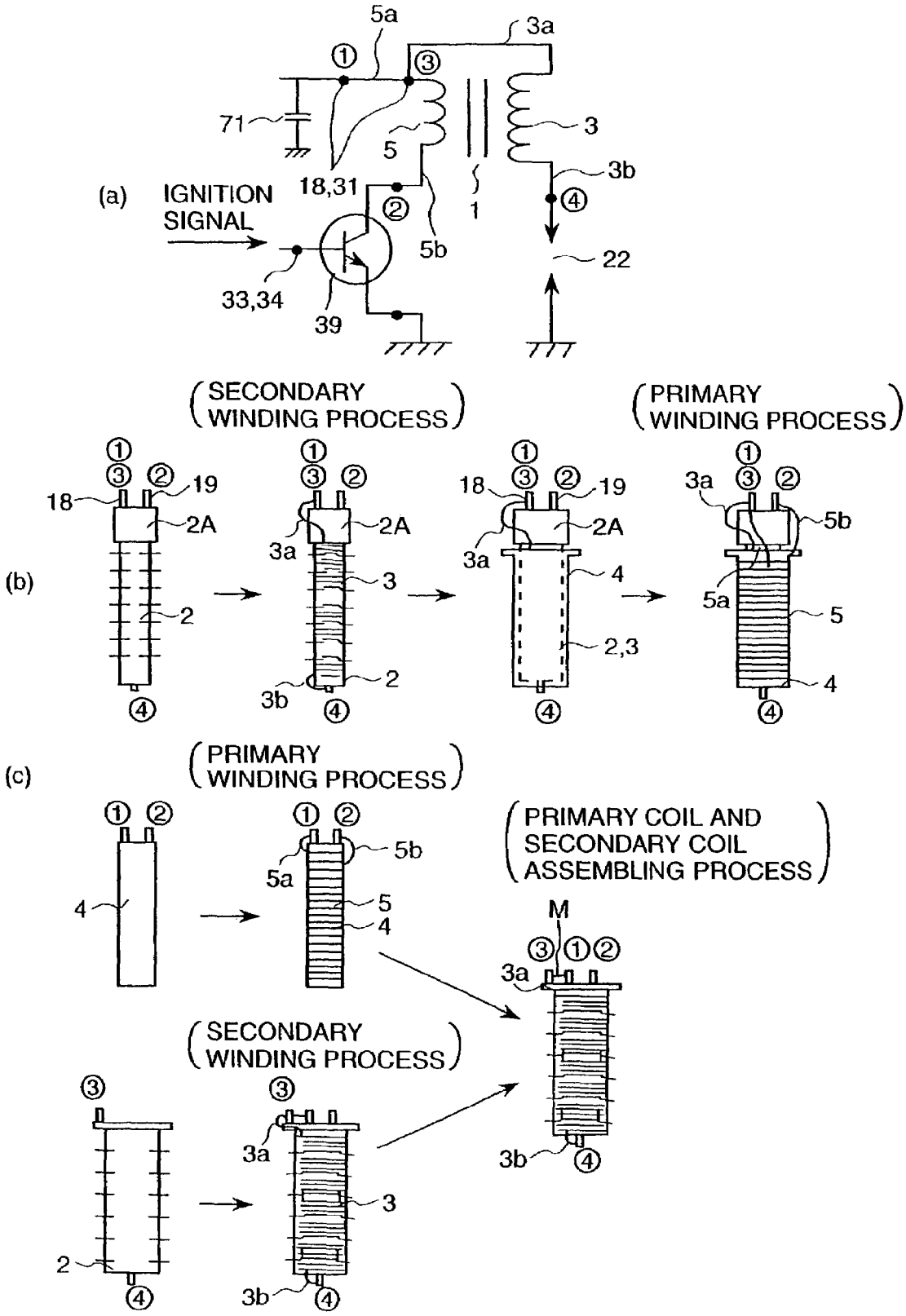
FIG. 11 are views in which (a) is a principle circuit view showing the ignition coil, (b) is an explanatory view showing a manufacture principle of the ignition coil according to the present invention, and (c) is an explanatory view showing a manufacture principle of the ignition coil according to the prior art.

Herein, the primary and secondary coils serving terminal 18 corresponds to the serving terminals ① and ③ shown in FIG. 11(*b*). Namely, the above stated coil terminal 18 works a role of functions in which the coil terminal (this corresponds to ③ terminal in the circuit in FIG. 11(*a*)) for connecting the power supply by taking out one end 3*a* of the secondary coil 3 and the coil terminal (this corresponds to ① terminal in the circuit in FIG. 11(*a*)) for connecting the power supply by taking out one end 5*a* of the primary coil 5.

On the other hand, the primary coil terminal 19 corresponds to ② terminal of the circuit shown in FIG. 11(*a*) and FIG. 11(*b*) and by taking out another end 5*b* of the primary coil 5 is connected to a collector of a power transistor 39 (an ignition coil drive element) of the ignition circuit unit.

Figure 14:
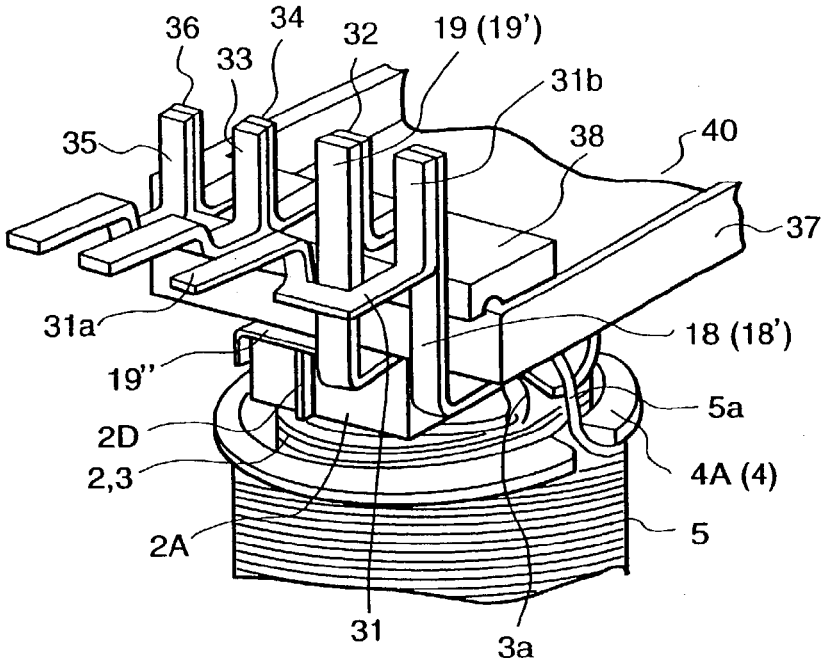
FIG. 14 is an explanatory view showing a position relationship between an ignition coil assembly and a circuit unit for use in the first embodiment.

As shown in FIG. 12 and FIG. 13, the primary and secondary coil serving terminal 18 is formed by a belt shape metal plate and through an installation leg portion 18*c* is fixed under pressure to a pocket 20 which is provided on one outer side face of the secondary bobbin head 2A. One end 18' of the terminal is formed with a raising portion having L shape and this raising portion 18' is jointed to one end 31*b* of a connector coil 31 for using the power supply input by means of the welding manner as shown in FIG. 1 and FIG. 14. Further, FIG. 14 is a squint enlargement view showing a combination relationship between the bobbin assembly (the primary and the secondary coils assembling) of the primary bobbin 4 being wound on the primary coil 5 and the secondary bobbin 2 being wound on the secondary coil 3, by taking out the coil case 6 and the ignition circuit case 9 from the ignition coil, and the ignition circuit unit 40 (it is called as an ignite) which is provided on the secondary bobbin head 2A. In this FIG. 14, the ignition circuit unit 40 and the drawing-out terminals 32, 34 and 36 are accommodated in actual in the circuit case 9 having the connector 9B as shown in FIG. 3 and further the parts of the connector terminals 31, 33 and 35 are buried in the circuit case (the resin case) 9.

The primary and secondary coils serving terminal 18 is formed with a single metal fitting and as shown in FIG. 12 and FIG. 13 a winding-up portion 18*a* by drawing out from the one end 3*a* of the secondary coil 3 and a winding-up portion 18*b* by drawing out from the one end 5*a* of the primary coil 5 are formed integrally. After the coil one ends 3*a* and 5*a* are wound by the wounding-up portions 18*a* and 18*b*, they are soldered. An upper flange 2B' of the secondary bobbin 2, a notch 2C is provided and leads the secondary coil one end 3*a* to the terminal metal fitting 18, similarly to the upper end flange 4A of the primary bobbin 4, a notch 4B is provided and leads the primary coil one end 5*a* to the terminal metal fitting 18.

The primary coil terminal 19 is formed with a belt shape metal sheet and is fixed under pressure a pocket (not shown in figure) which is provided at the outer side face of the side which opposes with the above stated pocket 20 installation position. One end 19' of the terminal is formed with a raising portion having L shape and an arm portion 19" for extending over horizontally is extended toward the primary and secondary coils serving terminal 18 and further a tip end portion 19' is lined up to arrange in parallel to a tip end portion 18' of the terminal 18 side at an approach position. This primary coil terminal 19 as shown in FIG. 14 is connected to the drawing-out terminal (the lead terminal) 32 of the ignition circuit unit 40 side by means of the welding manner. The drawing-out terminal 32 as shown in FIG. 1 and FIG. 3 is communicated electrically to the collector side of the power transistor 39 of the ignition circuit unit 40 through a wire bonding 42.

As shown in FIG. 14, in the connector terminal (the connector pin) in addition to the above stated connector terminal 31 the connectors 33 and 35 are provided.

Herein, a relationship between the connector terminals 31, 33 and 35 and the drive circuit for the ignition control will be explained.

Figure 4:
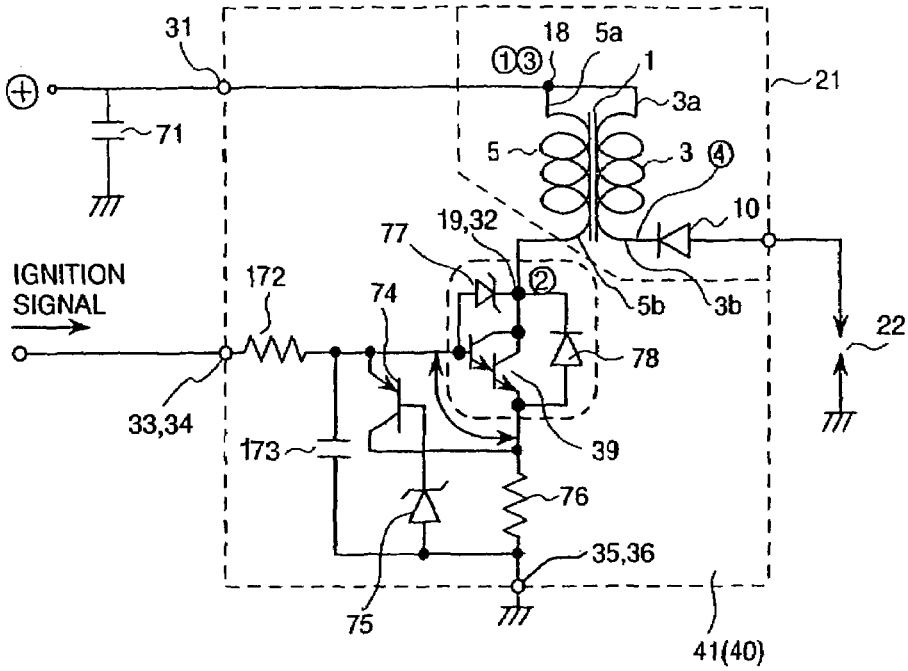
FIG. 4 is an ignition circuit for use in the first embodiment.

FIG. 4 is an electric wiring view showing the ignition circuit 41 which is mounted on the circuit case 9 of the ignition coil 21 and the primary coil 5 and the secondary coil 3.

The one end 5*a* of the primary coil 5 and the one end 3*a* of the secondary coil 3 are connected to + side of the direct current power supply through the primary and secondary coils serving terminal 18 which is provided on the secondary bobbin 2 and the connector terminal 31. The primary and secondary serving coils terminal 18 corresponds to the primary and secondary coils serving terminals ① and ③ shown in the ignition coil principle view shown in FIG. 11(*a*).

The another end 5*b* of the primary coil 5 is connected to the collector side of the Darlington connected power transistor 39 through the primary coil terminal 19 which is provided on the secondary bobbin and the lead terminal 32 which is provided on the ignition circuit unit 40. The primary coil terminal 19 corresponds to the above stated primary coil terminal ②.

The another end 3*b* of the secondary coil 3 is connected to the spark plug 22 through a high voltage diode 10. The high voltage diode 10 works a role in which a pre-ignition is prevented in a case where the high voltage generated in the secondary coil 3 is supplied to the spark plug 22 through a leaf spring member 11, a high voltage terminal 12, a spring member 13 shown in FIG. 1.

The ignition control signal which is generated in an engine control module not shown in figure is inputted into a base of the power transistor 39 through the connector terminal 33 and the lead terminal 34 which is provided on the ignition circuit unit 40. In accordance with this ignition control signal, the power transistor is carried out "on" and "off" control and the primary coil 5 is current-carrying controlled, accordingly in a case of during the cut-off of the primary coil 5 the high voltage for the ignition is induced to the secondary coil 3.

An emitter side of a second stage transistor of the power transistor 39 is connected and grounded through the lead terminal 39 which is provided on the ignition circuit unit 40 and the connector terminal 35.

As stated in the above, as shown in FIG. 3 and FIG. 14, the one end 18' of the primary and secondary coils serving terminal 18 and the one end 31*b* of the connector terminal 31 are connected by means of the welding manner, and the one end 19' of the primary coil terminal 19 and the one end of the lead terminal 32 of the ignition circuit unit side are connected by means of the welding manner. And further the one end of connector terminal 33 and the one end of the lead terminal 34 of the ignition circuit unit side are connected together with by means of the welding manner, and the one end of the connector 35 and the one end of the lead terminal 36 are connected together with by means of the welding manner.

Further, in FIG. 4, a reference numeral 71 denotes an anti-noise capacitor for preventing the noises which generates by the application control of the ignition coil and is arranged between the power supply line and the ground, in this embodiment this capacitor is arranged at an outer portion of the case which accommodates the ignition circuit unit. For example, the anti-noise capacitor 71 is arranged at a ground point of a wiring (an engine harness) in the engine room.

A resistor 172 provided between the ignition signal input terminal 34 and the base of the power transistor 39 and a capacitor 73 provided between the resistor 172 and the ground form a surge protection circuit. A transistor 74, a resistor 76, and a zenner diode 75 form a current limited circuit of the ignition control system. A reference numeral 77 denotes a primary voltage limited diode, 78 denotes a diode which constitutes a protection circuit during a reversal current application.

As shown in FIG. 1, FIG. 3 and FIG. 14, the lead terminals 32, 34 and 36 at the ignition circuit unit 40 side are fixed on a synthetic resin terminal stand 38 which is adhered to an aluminum metal base 37 which is carried out to a pressing formation with a box shape. Further, in the above stated terminals 18 and 31, the terminals 19 and 32, the terminals 33 and 34, and the terminals 35 and 36, since these joint portions those of are arranged in parallel toward for the same direction, so that the welding manner can be carried out easily.

In the ignition circuit unit 40, a hybrid IC circuit 41 comprised the above stated resistor 172, the capacitor 173, the transistor 74, the zenner diode 75 the resistor 76, the zenner diode 77, and the diode 78. And this circuit unit and the power transistor 39 are arranged in the metal base 37 and in the metal base 37 a silicon gel is filled up.

The circuit case (the igniter case) 9 for accommodating the ignition circuit unit 40 is molded integrally with the connector housing 9B for accommodating the above stated connector terminals 31, 33 and 35.

As shown in FIG. 1 and FIG. 3, in the circuit case 9, a portion for accommodating the ignition circuit unit 40 surrounds a case side wall 9A, further the ignition circuit unit 40, as shown in FIG. 3, is mounted by guiding a position determining projection member 9D on a floor face 9E (in a floor face) of a space which is surrounded by the side wall 9A. A central portion of the floor face 9E is opened by facing to an opening face of the coil case 6 side.

The circuit case 9 is formed separately to the coil case 6 and is combined under fitting and adhesion manner to the upper end of the coil case 6. In such a combination condition, as shown in FIG. 3 a projection member 6A provided on an upper portion periphery of the coil case 6 is engaged with to a dent groove 9F of the circuit case 9 side under a detent condition.

In the above stated combination condition, the metal base 37 of the ignition circuit unit 40 accommodated in the circuit case 9 is arranged just above to the head 2A of the secondary bobbin 2. One end 31' of the connector terminal 31 of the circuit case 9 and one end of the lead terminal 32 are set respectively to overlap to the primary and secondary coils serving terminal 18 which is provided at the secondary bobbin head 2A side and each one end of the primary coil terminal 19 in the circuit case 9, and accordingly the welding manner of the overlapped terminals can be carried out easily. Further, in a case of the setting of the ignition circuit unit 40, the drawing-out terminals 34 and 36 of the ignition circuit unit 40 side are positioned to align the respective corresponding connector terminals 33 and 35 as a matter of course.

Further, the circuit case 9 forms a flange 9C at a surrounding portion of the side wall 9A and to a part of this flange 9C a screw hole 25 is provided and the ignition coil 21 is installed to the engine cover. The interior portion of the circuit case 9 is covered by an insulation epoxy resin 43.

Next, the structures of the bottom portion sides of the secondary bobbin 2 and the primary bobbin 4 will be explained referring to FIG. 15 and FIG. 16.

Figure 15:
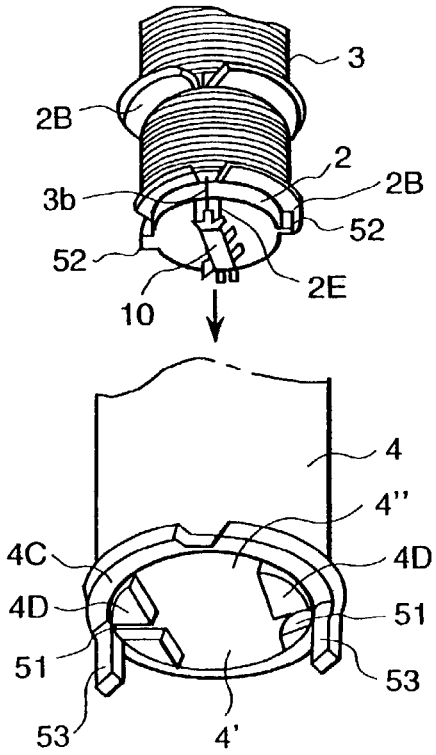
FIG. 15 is a partial squint view showing a condition the primary bobbin according to the first embodiment is inserted to the primary bobbin.

FIG. 15 is a squint view showing the bottom portion in a case where the secondary bobbin 2 and the secondary coil 3 are inserted to the primary bobbin 4. FIG. 16 is bottom face view showing the primary bobbin 4 and the secondary bobbin 2 and a bottom portion view showing a condition in which the primary bobbin and the secondary bobbin are assembled.

Figure 16:
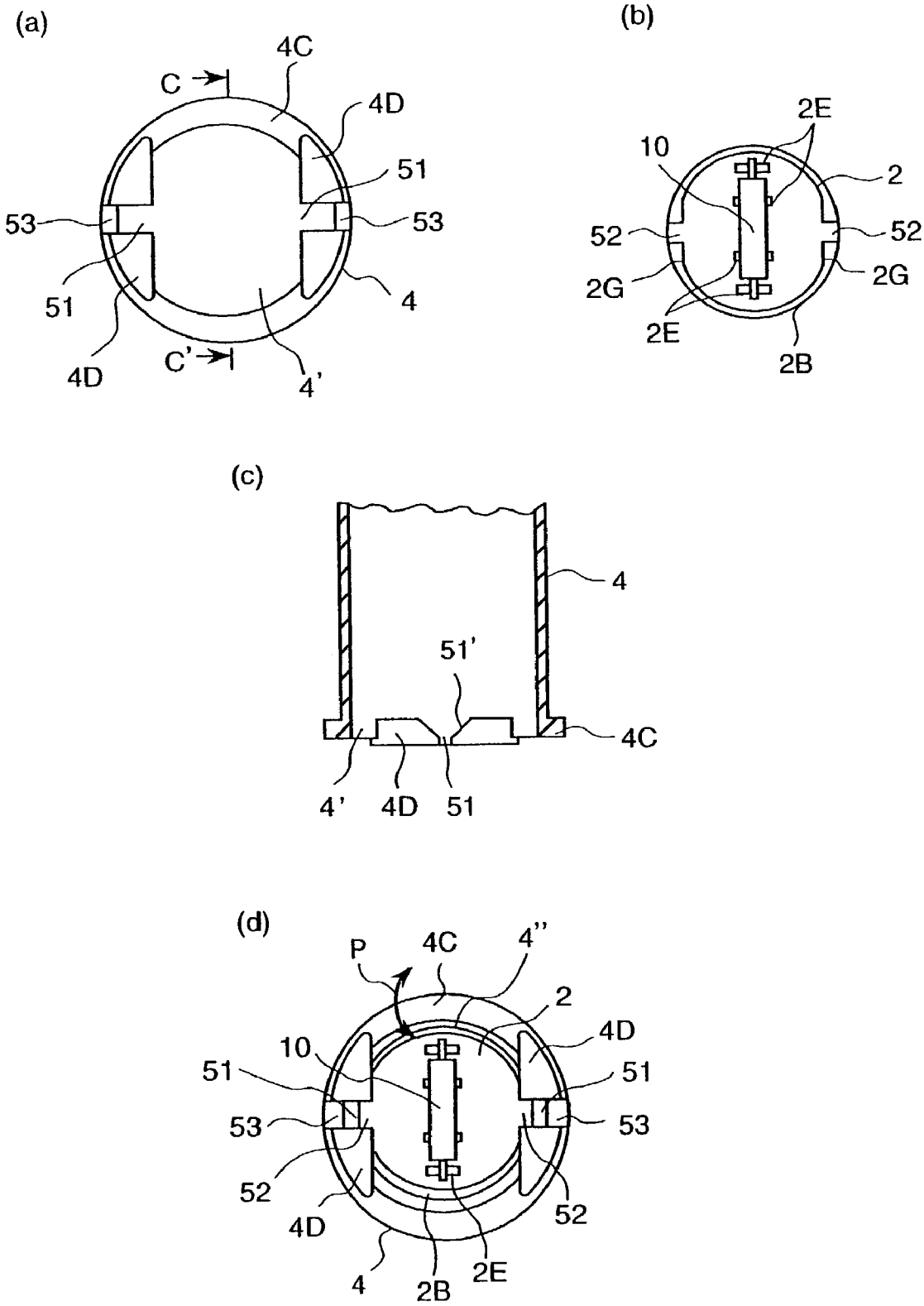
FIG. 16 are views in which (a) is a bottom face view showing the primary bobbin of the first embodiment, (b) is a bottom face view showing the secondary bobbin, (c) is C—C line cross-sectional view of the above stated (a), and (d) is a bottom face view showing the assemble condition of the primary bobbin and the secondary bobbin.
Figure 17:
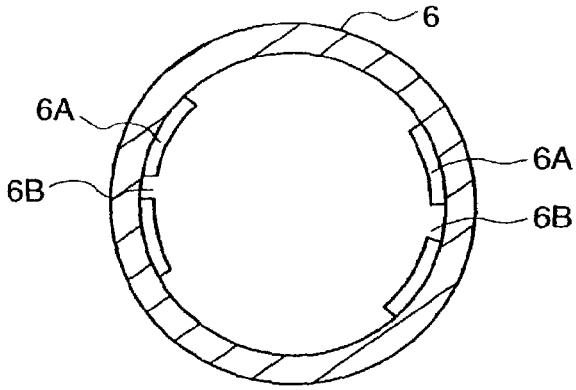
FIG. 17 is a cross-sectional view of a coil case for use in the first embodiment.

As shown in FIG. 15 and FIG. 16, the secondary bobbin 2 is formed with a cylindrical shape having a bottom portion by closing the bottom portion and at an outer face of the bottom portion the projection member 24 for installing the high voltage diode 10 is provided and. At the one end 3*b* of the secondary coil 3, as shown in FIG. 1, is connected to the high voltage terminal 12 through the high voltage diode 10 and the leaf spring member 11.

The bottom portion of the primary bobbin 4 is opened and when the secondary bobbin 2 is inserted to the primary bobbin 4, the high voltage diode 10 is projected over from the bottom portion opening 4' of the primary bobbin 4. Further, by sandwiching the opening 4' at the bottom portion of the primary bobbin 4 the opposing pair of secondary bobbin receiving portions 4D are arranged by projecting downwardly from the bottom portion flange (a bottom portion one end face) 4C.

The secondary bobbin receiving portions 4D receive the secondary bobbin 2 through the flange 2B (the lowest end flange) and an opposing side of the receiving portions 4D forms a linear line and an outline of the rest forms a circular arc shape. From the center portion of the opposing side toward a radial direction a dent portion (a groove portion 51) is provided. Since this dent portion is engaged with a dent and concave engagement to the concave portion 52 which is provided at the bottom portion side outer periphery of the secondary bobbin 2, the relative detent between the secondary bobbin 2 and the primary bobbin 4 is attained.

Further, at the bottom portion flange 4C of the primary bobbin 4, a pair of downward projection members 53 are provided and since this projection member 53 as shown in FIG. 15 are engaged with grooves 6B for positioning the primary bobbin receiving member 6A which is provided on a part of the inner periphery of the coil case 6, the relative detent between the coil case 6 and the primary bobbin 4 is attained.

The bottom portion 2 of the secondary bobbin 2, as shown in FIG. 16(*b*), has a substantially circle shape and has cut faces 2G forming a slightly plane face at a right and left sides. This cut faces 2G, as shown in FIG. 16(*d*), are fitted into the opposing side (the linear line) of the secondary bobbin receiving member 4D and is positioned to the bottom portion opening 4' of the primary bobbin 4. Further, at a position of the cut face 2G, the above stated concave portion 52 is provided.

At the dent portion 51 formed on the secondary bobbin receiving member 4D, as shown in FIG. 16(*c*), at the upper end a taper 51' is provided and by widening the width of the dent portion 51, even during the insertion of the secondary bobbin 2 the concave portion 52 is slipped off a little the dent portion 51 and the secondary bobbin is guided by the taper 51' and is inserted easily.

Further, since the secondary bobbin receiving member 4D provided on the bottom portion of the primary bobbin 4 side is oppositely arranged by sandwiching the bottom portion opening 4' and also is projected downwardly from the primary bobbin bottom portion, a side face space 4" having no secondary bobbin receiving member 2D con be secured at the primary bobbin 4 bottom portion. Through the side face space 4" as shown in an arrow mark P of FIG. 16(*d*) during the potting of the insulation resin 8' a good resin communication performance between the primary bobbin 4 and the secondary bobbin 2 (the secondary coil 3) and between the coil case 6 and the primary bobbin 4 (the primary coil 5) can be obtained and the bubbles in the potting insulation resin in the primary bobbin 4 bottom portion can be taken out.

At the bottom portion of the secondary bobbin 2, the magnet 15 and the foam rubbers 45 are arranged with a laminated layer shape and on above the center core 1 is inserted. Since this magnet 15 and the magnet 16 provided on the secondary bobbin head 2A generate the opposing direction magnetic fluxes in the magnetic paths (the center core 1, and the side core 7), the ignition coil can be operated under less than the saturation point of the magnetized curve of the core.

The foam rubber 45 absorbs the difference in thermal expansion of the center core 1 and the secondary bobbin 2 by accompanying with the temperature change during the potting and the use time of the insulation resin 8 of the ignition coil 21 (the thermal stress mitigation).

In the lower end of the coil case 6, a cylindrical wall 6' for inserting the spark plug 22 (confer FIG. 5) is formed by surrounding the spring member 13. This cylindrical wall 6' is formed integrally with the coil case 6 and to this cylindrical wall 6' a boot for insulation and mounting the spark plug 22, for example a rubber boot 14, is installed.

FIG. 5 shows a condition in which the ignition coil 21 having the above stated construction is mounted on the plug hole 23 of the engine.

In the ignition coil 21, the coil portion is penetrated to the head cover (the cover for covering the cylinder head) 24 and through a plug tube 23A is inserted to the plug hole 23B. The rubber boot 14 is adhered to the surrounding portion of the spark plug 22 and a part of the spark plug 22 is introduced to one end cylindrical wall 6' of the coil case 6 and presses to the spring member 13, as a result the ignition coil 21 is connected directly to the spark plug 22 in the plug hole 23B. In the ignition coil 21, the screw hole 25 (confer FIG. 1) provided on the coil case 6 and a screw hole 26 provided on the engine cover 24 are fastened up by means of the screw members 27 and a sealing rubber 28 provided on the upper portion of the coil case 6 is fitted to a ring shape concave portion 29 provided on a circumferential periphery of the ignition coil insertion hole of the head cover 24 of the engine, as a result the ignition coil is fixed.

In the inner face of the sealing rubber 28, as shown in FIG. 1 a longitudinal groove 92 is provided. This longitudinal groove 92 has a function in which during the mounting of the sealing rubber 28 and the ignition coil 21 together with the air in the flange (a fitting into portion to the concave portion 29 at the engine cover side) of the sealing rubber 28 is let to escape and an installation working of the sealing rubber 28 is done easily and further has a function by communicating to the atmosphere the atmospheric pressure condition is held. The reasons for providing the latter stated function are that when if the longitudinal groove 92 is not provided, the inner portion of the engine head cover 24 which presents the high temperature condition according to the engine heat receives the water and is cooled abruptly and invites the negative pressure condition, and as a result even the provision of the sealing rubber 28, according to the negative pressure force the water, which is stored at the surrounding portion of the sealing rubber 28, is drawn into, therefore the function does not invite such an above stated negative pressure. An air take-in port of the groove 92 is set to a high position some degree from the engine cover to not flow into the stored water (the water in which a vehicle hits and is entered into such as water on a road) on the engine cover.

In this embodiment, the head cover 24 of the engine head 100 (the cylinder head) is made of the plastic material (for example, 6 nylon, 66 nylon) and in a case where to this head cover the individual ignition type ignition coil is installed, the coil portion is inserted to the plug hole 23A and the plug tube 23B. As a result, the center of gravity W of the ignition coil is positioned at a lower position from the head cover 24, in this case the center of gravity is transferred in the inner portion of the ignition coil plug tube 23B (in a case where the length of the coil portion of the pencil type coil is 85–100 mm, the center of gravity W is positioned a lower position with 50–70 mm from the coil portion upper end). Further, in the pencil type coil, the comparatively light case 9 having the connector is fixed (for example, the screw fastening 27) to the outer face of the plastic head cover 24 and at the plug combined position between this fixing portion and the plug hole two point support structure at the axial direction can be obtained. As a result, the vibration of the whole ignition coil can be lessened and the vibration of the ignition coil for giving to the plastic head cover 24 can be restrained and the light structure (the thin structure) and the simplification of the plastic head cover can be attained, therefore it is possible to realize the mounting for the individual ignition type ignition coil.

Next, the procedure of a case for manufacturing the ignition coil 21 comprised of the above stated construction will be explained referring to FIG. 18 and FIG. 19.

Figure 18:
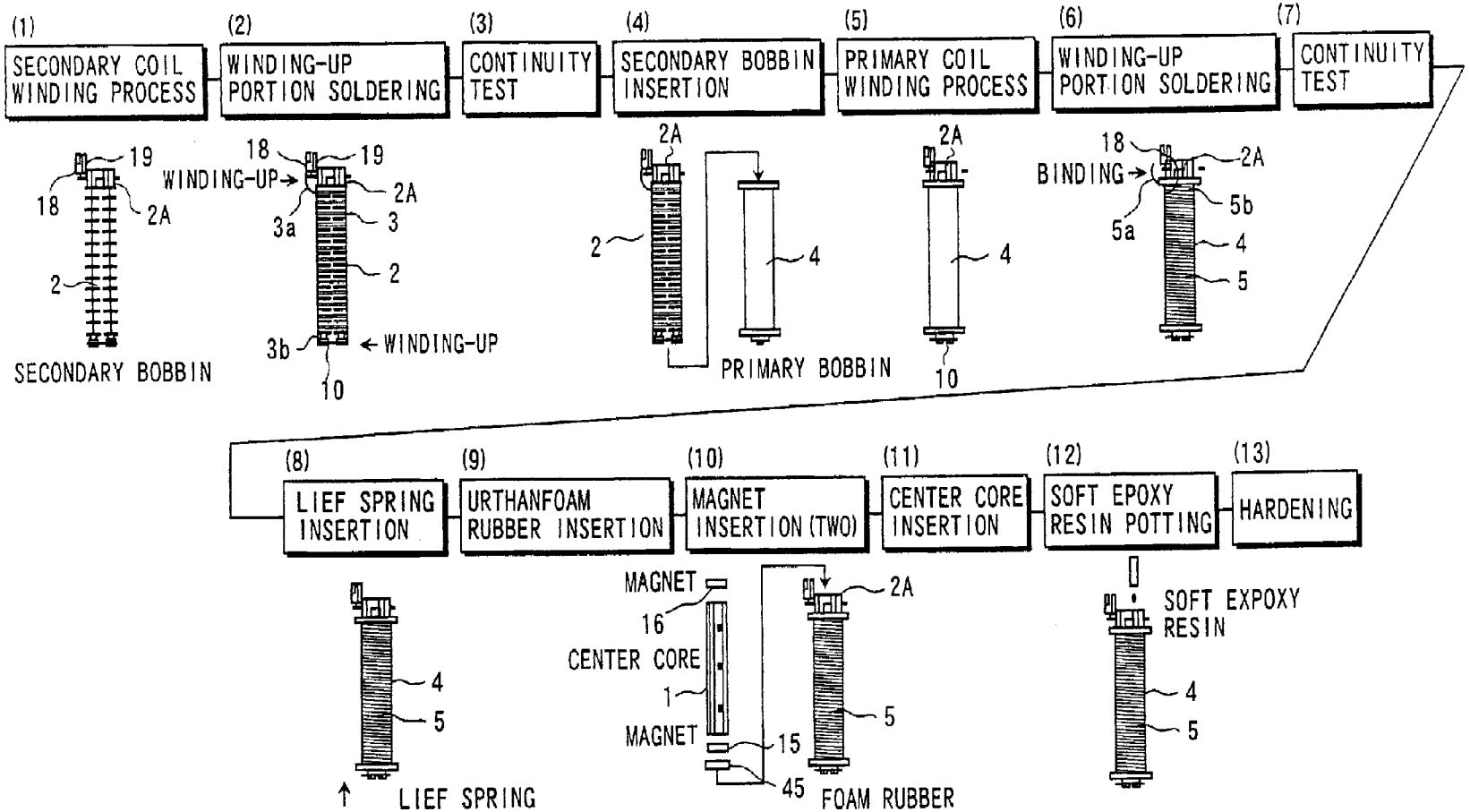
FIG. 18 is an explanatory view showing a manufacture process of the ignition coil.

As shown in FIG. 18, first of all the secondary coil 3 is wound round to the secondary bobbin 2 and the coil one end 3*a* of the secondary coil is connected to the primary and secondary coils serving terminal 18. This connection is carried out by wounding-up the coil one end 3*a* to the terminal 18 by means of the soldering manner. Further, the another end 3*b* of the secondary coil 3 is connected to the secondary coil terminal at the high voltage side (herein, the high voltage diode 10). After that the continuity test is carried out.

The secondary bobbin 2 wound round the secondary coil 3 is inserted and fixed to the primary bobbin 4 and with this condition (the primary and the secondary bobbins overlapping condition) the primary coil 5 is wound round the primary bobbin 4 and the one end 5*a* of the primary coil is connected to the primary and secondary coils serving terminal 18 and the another end of the primary coil is connected to the primary coil terminal 19. These connections are carried out by means of the coil winding round manner and the soldering manner. In this case, since the primary and secondary coils serving terminal 18 and the primary coil terminal 19 together with the secondary bobbin head 2A are provided to the secondary bobbin 2 side, the terminals 18 and 19 are positioned outside the one end of the primary bobbin, 4 the both ends 5*a* and 5*b* of the primary coil 5 are led easily to the terminals 18 and 19 and after that it is possible to carry out the winding-up working and the soldering working. After that the continuity test for the primary coil is carried out.

Next, to connect the leaf spring member 11 (confer FIG. 19) to the high voltage diode 10, after the spring member is combined with the lead terminal of the high voltage diode 10, the foam rubber 45, the magnets 15, the center core 1, and the magnets 16 are inserted to the primary bobbin 2 and after that the soft epoxy resin 17 is potted and hardened in the secondary bobbin 2.

Herein, the winding machine used for the winding process of the secondary coil 3 and the winding process of the primary coil 5 will be omitted in the figure, however basically the bobbin is set to the rotating shaft and by rotating the bobbin the enamel wire is wound round, as the application examples of this the various kinds embodiments will be considered.

As one of them, it is considered that on one stand winding machine an enamel wire reel for the primary coil and an enamel wire reel for the secondary coil are provided, a hand mechanism is provided in which from these reels by drawing out the respective enamel wire and the reciprocating and swirling operation necessary for the winding is carried out at the vicinity of the rotating shaft, therefore using only one stand winding machine the winding for the primary coil and the secondary coil is carried out. In this case, with the secondary bobbin structure used in this embodiment, the sharing of the rotating shaft in the winding machine can be attained.

Figure 20:
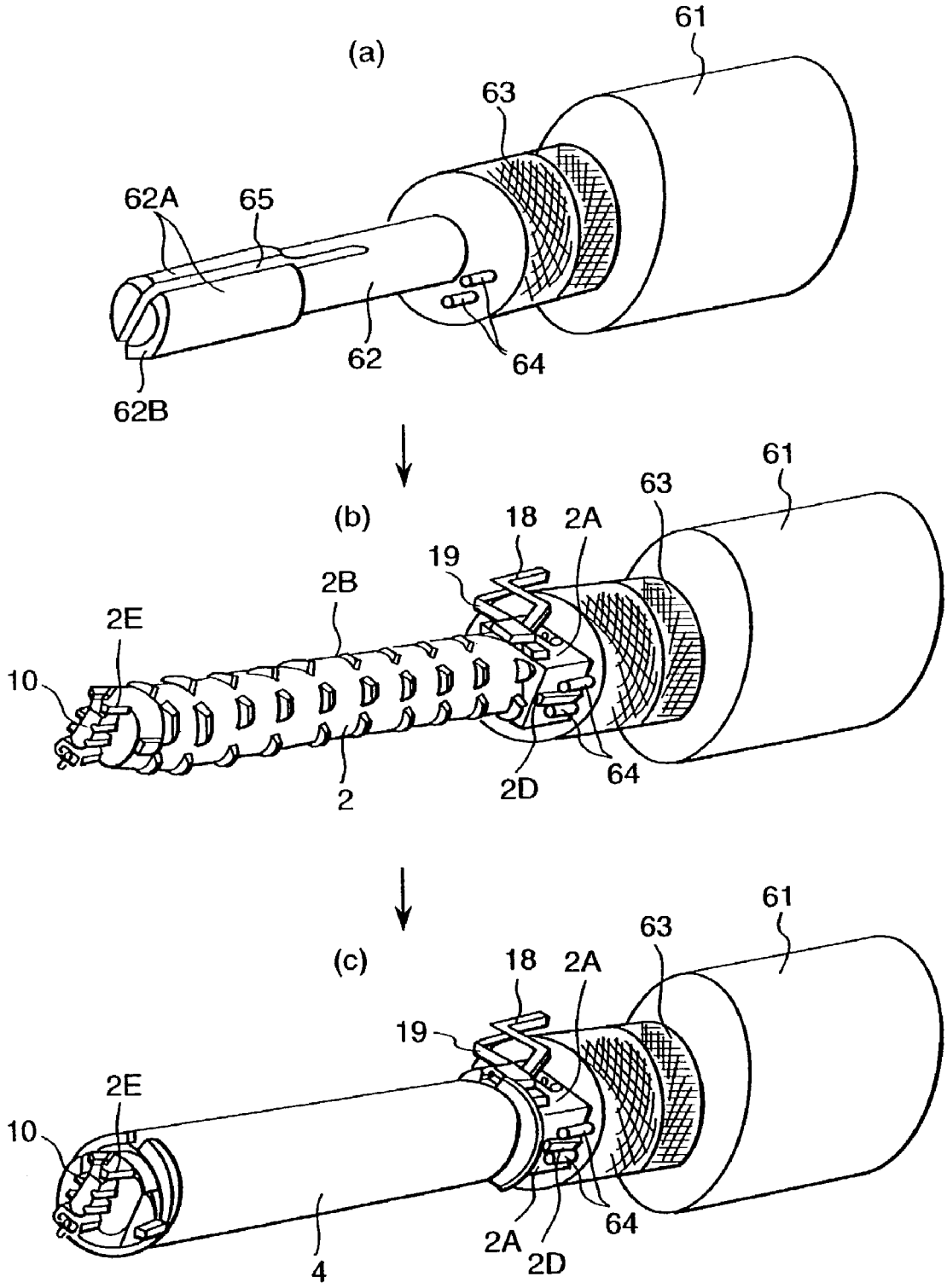
FIG. 20 is an explanatory view showing an installation example between a rotative shaft of a winding machine and the primary bobbin and the secondary bobbin.

FIG. 20 shows the rotating mechanism of the above stated winding machine. The rotating mechanism is classified roughly into a rotating shaft 62 and a motor 61. The rotating shaft 62 is combined detachably to an output shaft 62' (confer FIG. 21) of the motor 61 through a joint (a coupling) 63 which forms a part of the shaft 62 and the joint structure in which the rotating shaft 62 rotates the output shaft together with is employed. The rotating shaft 62 is formed with a cotter pin shape by forming a slit 65 from a tip end to a midway position. And in a condition of before the insertion of the secondary bobbin 2, at least part 62A of the cotter pin portion of the rotating shaft 62 is enlarged from the inner diameter of the secondary bobbin 2 and further at the tip portion a taper 62B for guiding the secondary bobbin 2 is provided. Further, at a part (herein, one end face of the joint 63) of the rotating shaft 62 two pins 64 for positioning and detenting the bobbin are provided and are engaged with the engagement portion 2D which is provided on the secondary bobbin head 2A and between the pins 64 the engagement portion 2D of the secondary bobbin head 2A is engaged.

In the case of the use of the above stated sharing winding machine, as shown in FIGS. 20(*a*), 20(*b*), the secondary bobbin 2 is pushed on to the rotating shaft 62 of the winding machine utilizing the shaft taper 62B, the cotter pin portion 62A of the shaft 62 is varied elasticity toward a direction where the diameter of the cotter pin portion becomes small, and the secondary bobbin 2 is inserted and set to the rotating shaft 62. In this time, the cotter pin portion 62A is pressed to an inner face of the bobbin 2 by the elastic returning force of the corer pin portion itself and further since the engagement portion 2D provided on the secondary bobbin head 2A is engaged with the between of the detent pin 64 of the rotating shaft, as a result the both ends of the secondary bobbin 2 are fixed strongly on the rotating shaft 62.

As a result, during the secondary winding by forming a cantilever structure the rotating shaft 62 the secondary bobbin 2 together with the rotating shaft 62 is made to a high-speed rotation, since the slipping and the rotation swing do not cause on the secondary bobbin 2, accordingly it is possible to carry out the winding of the secondary coil 3 in which the minute winding having the high accuracy is required.

After the winding of the secondary coil 3 and the winding-up (including the soldering) to the coil terminal 18 of the secondary coil end have practiced, as shown in FIG. 20(*c*), leaving the installation of the secondary bobbin 2 to the rotating shaft 62, at the outer side of the secondary bobbin the primary bobbin 4 is inserted through the detent members 52 and 51 (shown in FIG. 15 and FIG. 16) of the bobbins and by a bobbin supporting tool not shown in figure one end (a side where the high voltage diode 10 of the secondary bobbin is positioned) of the primary bobbin 4 is supported rotatively and by rotating the primary bobbin 4 and the secondary bobbin 2 with together the primary coil 5 is wound round to the primary bobbin 4.

Figure 21:
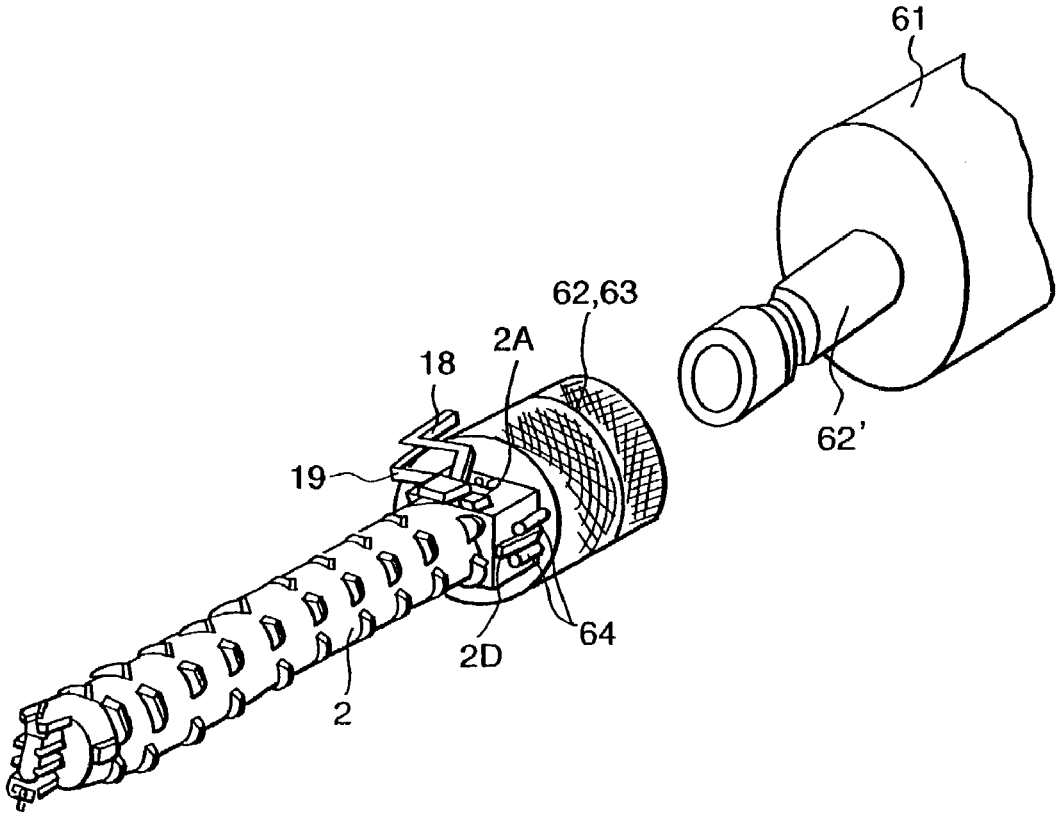
FIG. 21 is an explanatory view showing a condition in which the rotative shaft during the secondary bobbin insertion condition is taken off from a motor of the winding machine.

In addition to the above stated winding method, the winding machine for the secondary coil and the winding machine for the primary coil are provided separately, only the rotating shaft 62 for the winding, as shown in FIG. 21, is formed detachably and as a result it is possible to share the primary winding machine and the secondary winding machine.

In this case, first of all, the rotating shaft 62 is installed to the winding machine (herein, a motor of the secondary winding machine) similarly to FIG. 20(*a*), under a setting embodiment similarly to FIG. 20(*b*) the secondary bobbin 2 is inserted and set to the rotating shaft 62 through the head 2A, and rotating the rotating shaft 62 and the secondary bobbin 2 together with and then the secondary coil 3 is wound around to the secondary bobbin 2.

After that, by leaving the installation of the secondary bobbin 2, the rotating shaft 62 is taken off from the secondary winding machine (confer FIG. 21), the rotating shaft 62 is installed to the primary winding machine and at the outer side of the secondary bobbin 2 the primary bobbin 4 is inserted to the detent members 51 and 52 of the bobbins similarly to the above stated FIG. 20(*c*), and by rotating the primary bobbin 4 and the secondary bobbin 2 with together the primary coil 5 is wound on the primary bobbin 4.

Figure 19:
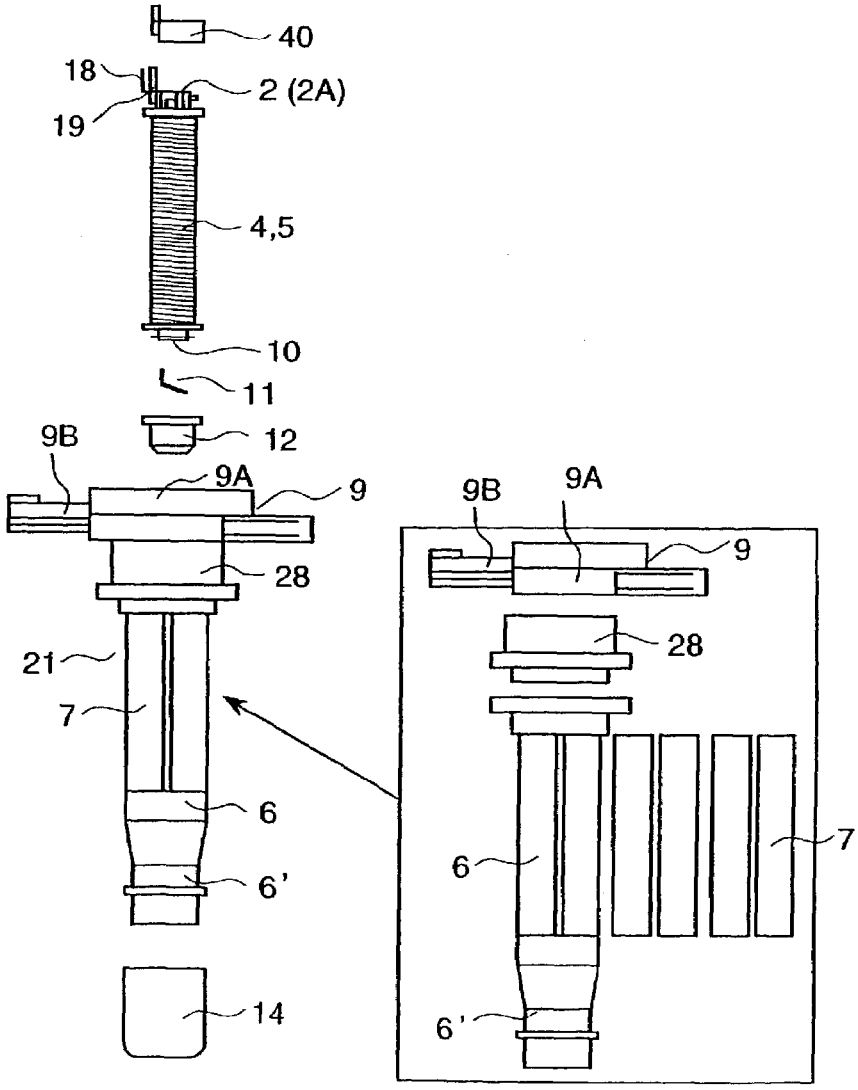
FIG. 19 is an explanatory view showing a manufacture example of the ignition coil.

The coil assembly body manufactured by the way of the above stated series processes shown in FIG. 18 is inserted, as shown in FIG. 19, together with the high voltage terminal 12, the leaf spring member 11, the ignition circuit unit 40 to the assembly body comprised of the coil case 6 and the circuit case 9. Herein, as stated in the above, the primary and secondary coils serving terminal 18 and the connector terminal 31, the primary coil terminal 19 and the lead terminal 32 at the ignition circuit unit side, the connector terminal 33 and the lead terminal 34 at the ignition circuit unit side, and the connector terminal 35 and the lead terminal 36 are connected respectively by means of the projection welding manner.

Prior to the insertion of the above stated coil assembly body to the coil case 6, the circuit case 9 and the coil case 6 are fitted into and adhered, further after the insertion of the coil assembly body the insertion under pressure of the side core 7 and the insertion under pressure of the rubber boot 14 to the coil case 6 are carried out and further the potting and the hardening of the epoxy resin 8 are carried out.

The main operations and effects according to this embodiment are as following.

(1) Since the soft resin 17 is filled up smoothly between the extremely narrow gap between the center core 1 and the secondary bobbin 2, the quality improvement of the manufacturing product can be attained and the anti-thermal shock between the center core 1 and the secondary bobbin 2 against to the repeat thermal stress in the engine severe temperature environment can be heightened.

(2) Since the secondary coil high voltage side of the coil portion of the ignition coil is connected directly to the spark plug 22 of the cylinder head, the secondary coil high voltage side receives extremely the thermal affect of the engine combustion. As a result, in a case where there is no consideration about this fact, the secondary coil voltage side of the secondary bobbin 2 presents the higher temperature condition than the secondary coil low voltage side and this becomes the causes in which the insulation performance lowers and the thermal stress becomes large. According to the present invention, since the secondary bobbin thickness at the secondary coil low voltage side is made thin and toward for the secondary coil pressure side the secondary bobbin thickness is made thick, with the thickness increase part the insulation performance and the anti-thermal stress at the secondary coil high voltage side can be heightened and it can cope with the above stated thermal affect of the engine combustion.

(3) Since PPS is used for the bobbin material such as the secondary bobbin 2 etc., in comparison with the molding of the these bobbins using the modified PPO, the thickness can be made thin, further since the thin layer structure of the soft epoxy resin 17 can be attained. As a result, the thickness of another insulation materials (the epoxy resin 8 between the secondary coil and the primary bobbin) can be increased fully, the insulation performance and the anti-heat shock performance of the coil mold can be heightened. In particularly, it is impossible to change hardly the specification of the outer diameter of the apparatus main body and the specification of the inner and outer diameters of the primary coil 5 and the secondary coil 3, since a room for the improvement is left about the thickness of the above stated secondary bobbin 2 and the insulation resin layer between the center core 1 and the secondary bobbin 2, as a result the effects are big.

(4) Since the glass transition point Tg of the soft epoxy resin 17 is determined by the allowable stress of the secondary bobbin 2 in addition to the anti-heat shock performance of the rein 17, the both requirements of the anti-heat shock performance and the anti-stress performance of the important part (the insulation layer between the center core 1 and the secondary coil 3), which is required the insulation performance of the coil portion of the secondary wire being arranged inside the primary wire, can be satisfied.

(5) Since the thickness of the soft resin 17, the secondary bobbin 2, the primary bobbin 4, and the epoxy resin 8 are set under the reasonable bases, the occupied area of the center core of the coil in which the size is regulated can be enlarged and as a result the output improvement can be attained.

(6) By the compression molding for the soft epoxy resin 17 which is filled up the gap of the coil constitution member, the voidless can be attained and the reliability of the insulation performance of the pencil type coil can be heightened.

(7) Since the components of the center core 1 and the magentas 15 and 16 etc. of the secondary bobbin 2 are restrained concentrically by the dent 17' which is caused according to the compression molding of the soft epoxy resin 17, the anti-vibration performance of the center core etc. can be improved. In particularly, in this embodiment, even the insulation resin 17 is the soft material, since the concentric pushing-up force according to the dent 17' is acted on the elastic member 45 through the center core 1, the center core 1 is fixed strongly by the concentric pushing-up force according to the dent 17' and the reaction force according to the elastic member 45, as a result the anti-vibration performance against the vibration which causes by the magnetic vibration generated to the center core and by the engine can be improved. Further, since the dent 17' is buried by the epoxy resin 8, the gap between the circuit case 9 and the center core 1 is get rid of, as a result the insulation destroy between the circuit base 37 and the center core 1 can be prevented.

(8) Since the individual ignition type ignition coil can be mounted with no obstacle to the plastic engine head cover, the light weight structure of the engine can be obtained.

(9) Further, in the pencil type coil according to this embodiment, as a result of the repeated thermal stress test between −40° C./1 h (hour) and 130° C./1 h, the good durability performance more than 300 cycle can be confirmed.

As to the soft epoxy resin 17, in place of this it is possible to use the insulation soft material resin such as the silicon rubber and the silicon gel etc.

According to this embodiment, in addition to the above following effects can be obtained.

(10) As to the secondary coil 3 which requires the minute winding, the coil is carried out the pre-winding and at the outer side of the secondary bobbin 2 on which the secondary coil is wound the primary bobbin 4 is fitted into by guaranteeing the detent members of the bobbins together with and by rotating the secondary bobbin 4 together with the secondary bobbin 2, the primary coil is wound to the primary bobbin 4. According to this manner, since the primary coil 5 is not required the minute winding in comparison with the that of the secondary coil 3 and the winding is easily, there is no obstacle. As a result, it is possible to carry out the coil winding working under the assembled (overlapping) condition of the primary bobbin and the secondary bobbin.

(11) As a result of the possibility of the winding working under the above stated bobbin assemble condition, the sharing of the primary and secondary winding machine, or the sharing the rotating shaft of the primary and secondary winding machine, or the unification (the compatibility of the shaft) of the type of the rotating shaft of the primary and secondary winding machine can be attained.

(12) Further, since the primary and secondary coils serving terminal 18 (① ③)) is provided on the secondary bobbin 2, the necessity for connecting the primary terminal (①) and the secondary terminal (③) through a crossover wire M (confer FIG. 6(*c*)) shown in the prior art can be gotten rid of, as a result the connection process for the crossover wire M can be omitted. Further, in accordance with the grantee of the primary winding under the bobbin assemble condition, the primary coil can be connected directly to the primary and secondary coils serving terminal 18 provided at the secondary bobbin 2 without the temporary installation of the primary coil 5 to the primary bobbin 4 and to the primary coil terminal 19. Further, FIG. 6(*c*) shows the assembling process of the secondary wire being arranged outside primary wire in which the primary coil is inside and the secondary coil is outside according to the prior art.

(13) Since the head 2A of the secondary bobbin 2 which is inserted to the primary bobbin 4 is projected over from the primary bobbin 3, even a case where the above stated the primary and secondary coils serving terminal 18 and the primary coil terminal 19 are provided to the secondary bobbin 2, the installation space can be obtained fully.

(14) In the case where the circuit case 9 is combined to the upper end of the coil case 6 by means of the fitting into manner and the adhesion manner, the one end 31' of the connector terminal 31 of the circuit case 9 and the one end of the lead terminal 32 is set respectively to overlap in the circuit case 9 each one end of the primary and secondary coils serving terminal 18 provided at the secondary bobbin head 2A side and the primary coil terminal 19, as a result the welding working of these overlapping terminals each other can be carried out easily. Further, since the circuit unit 40 is positioned accurately through the positioning determining member 9D, the positioning determination between the lead terminal 34 at the connector terminal 33 and the circuit unit side and the lead terminal 36 at the connector 34 and the circuit unit side can be carried out accurately. As a result, during the joining of the terminals each other the slip-off in the position does not cause and the workability and the quality improvement can be heightened.

(15) Since the side face space 4" having no secondary bobbin receiving member 2D is secured at the bottom portion of the primary bobbin 4, during the potting of the insulation resin 8, the good resin flowability of the gap between the inner and the outer peripheries of the primary bobbin 4 and the secondary bobbin 2 (the secondary coil 3) and the gap between the inner and the outer peripheries of the case 6 and the primary bobbin 4 (the primary coil 5) can be obtained and the good bubble release in the potted insulation resin of the bottom portion of the primary bobbin 4 can be obtained, as a result the insulation performance of the ignition coil can be improved.

Next, a second embodiment according to the present invention will be explained referring to from FIG. 22 to FIG. 29.

Figure 22:
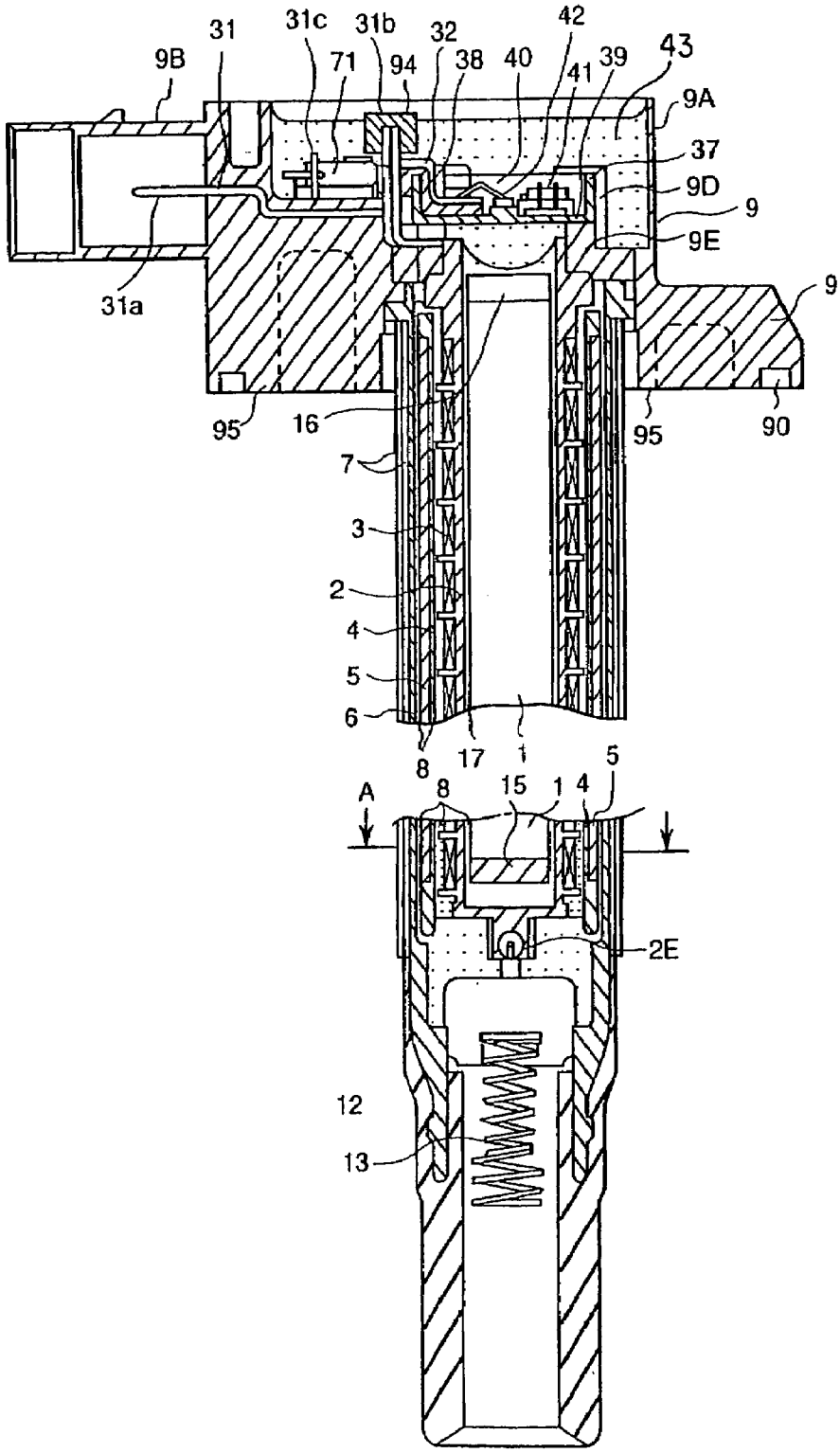
FIG. 22 is an essential cross-sectional view showing the ignition coil of a second embodiment according to the present invention (D—D line cross-sectional view of FIG. 23).
Figure 23:
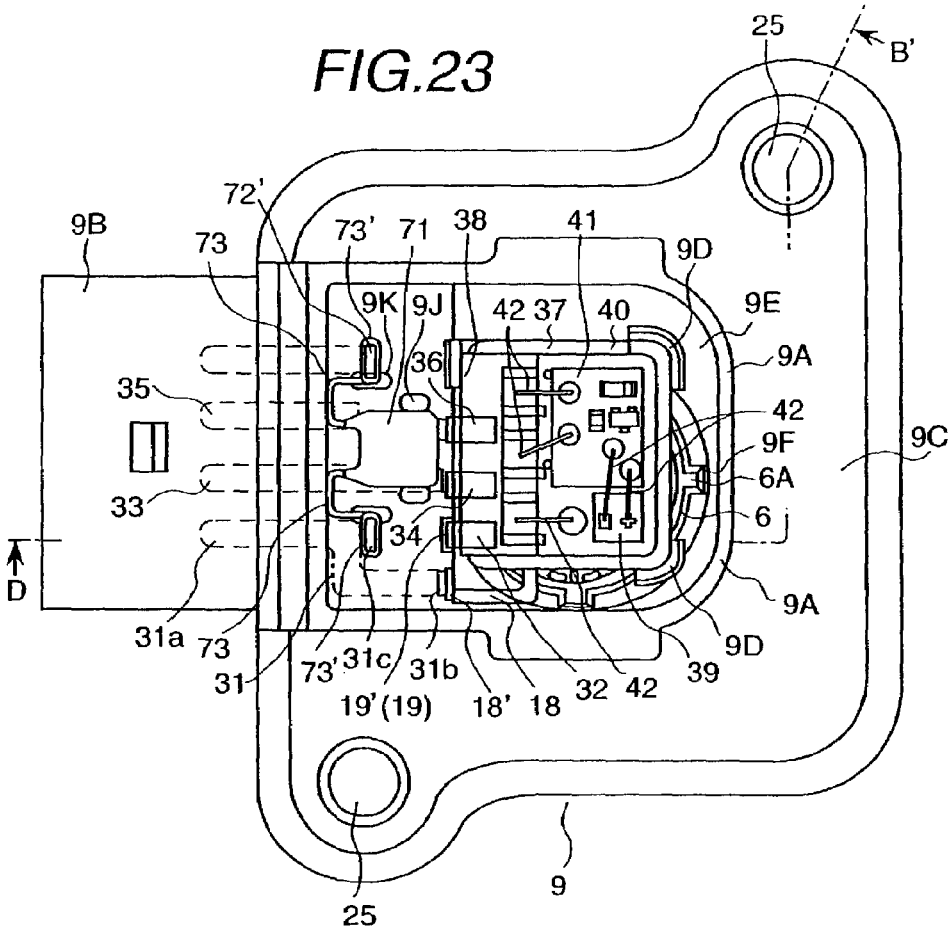
FIG. 23 is a view taken from an upper face of the ignition coil of FIG. 22 and a view in which an interior portion of the circuit case is expressed under a condition before the resin fill-up.

FIG. 22 is a partially cross-sectional view (D–D' line cross-sectional view of FIG. 23) of an ignition coil according to the second embodiment. In this figure, the same ones of the reference numerals used in the first embodiment indicate the same ones or the common elements. FIG. 18 is a view taken from an upper face of the ignition coil of FIG. 17 and expresses a condition before the resin fill-up of the interior portion of the circuit case. Further, F–F' line cross-section view of FIG. 22 is omitted because this view is the similar to FIG. 2.

In this embodiment, the main differences which differ from the first embodiment will be stated.

An ignition noise prevention use capacitor 71 (hereinafter, it is called as the noise prevention capacitor 71) in this embodiment is mounted in an interior portion of the circuit case 9. As a result, in addition to the metal fittings of the already stated connector terminals (the power supply connection use connector terminal 31, the ignition signal input use connector terminal 33, the ignition circuit ground use terminal 35), a metal fitting of the ground exclusive connector (a capacitor ground use terminal) 72 of the noise prevention capacitor 71 is added and this is accommodated in a connector housing 9B. And the noise prevention capacitor 71 is connected between this connector terminal 72 and the power supply connection use (+ power supply) connector terminal 31.

In the circuit case 9, since the space for accommodating the ignition circuit unit 40 is extended from that of the first embodiment, the noise prevention capacitor 71 is installed in this accommodation space. The connector terminals 31–35 and the intermediate portion of the connector terminal 72 are buried in the case 9 resin and the installation portion of the noise prevention capacitor 71 is provided on above the floor face of the case 9 near the buried position.

Further, at the intermediate portion of the power supply connection use connector terminal 31 and the one end of the capacitor ground terminal 72, a portion of the metal fitting is folded to arise vertically (including substantial vertical), and this folded portions (the raising portions) 31*c* and 72' are projected from the case 9 floor face and they are arranged at both sides of the noise prevention capacitor 71. Both lead wires 73 of the noise prevention capacitor 71 are connected respectively to the folded portions 31*c* and 72'. In this embodiment, the lead wire 73 of the capacitor 71 is wound up to the terminal folded portions 31*c* and 72' and are carried out to soldering manner (confer FIG. 28).

Herein, one end (the wound-up portion) 73' of the lead wire 73 is made a loop shape in advance before the connection to the terminals 31 and 72 and the loop 73' is fitted into the terminal folded portions 31*c* and 72' from the upper portion. A reference numeral 9K shown in FIG. 23 denotes a projection member which is provided on the floor face (the inner bottom) 9E of the case 9 and this projection member is positioned adjacently to the terminal folded portions 31*c* and 72' and is formed to project vertically from the floor face 9K. Further, one side of the terminal folded portions 31*c* and 72' is gnaw into this projection member 9K and thus the molding is carried out. Further, the height of the projection member 9K is lower than the height of the terminal folded portion 31*c*, as a result in a case where the one end 73' of the above stated loop shape lead wire is fitted into the upper ends of the terminal folded portions 31*c* and 72' and is taken down, since the one end 73' of the lead wire is hit to the upper end of the projection member 9K in the midway position, therefore the further downfall can be prevented. With the above stated manner, the height direction positioning of the lead wire 73 and also that of the noise prevention use capacitor 71 are determined.

Figure 29:
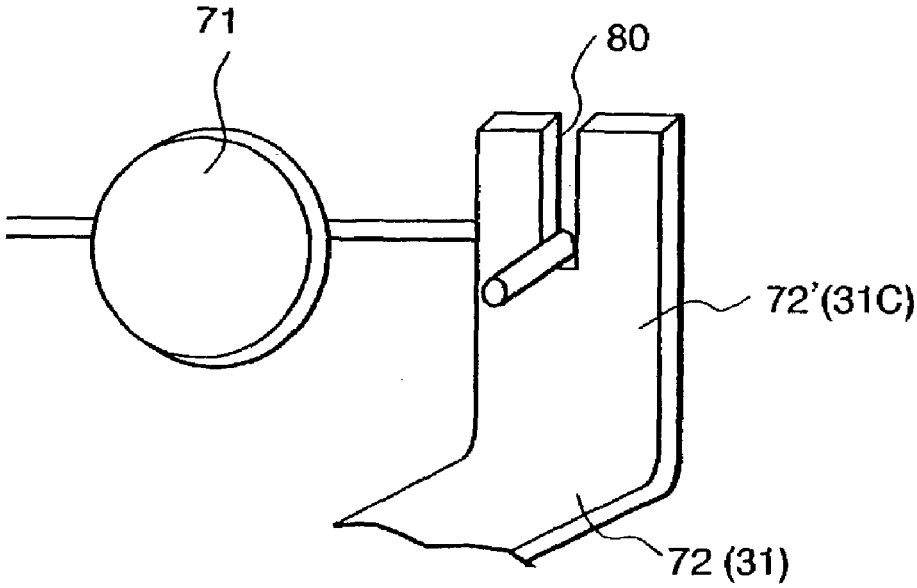
FIG. 29 is an explanatory view showing an installation condition of the noise prevention capacitor for use in the second embodiment.

Further, a reference numeral 9J denotes a projection member which carries out the lateral direction positioning of the noise prevention use capacitor 71 and two projection members are projecting formed from the floor face 9E of the circuit case 9. Further, as shown in FIG. 29, in the terminal folded portions 31*c* and 72' slits 80 are formed and by sandwiching the lead wire 73 of the capacitor 71 to the slits 70 the soldering manner is carried out. According to these lead wire connections, the lead wire fixing in the soldering working can be done easily and as a result the workability can be improved.

Figure 26:
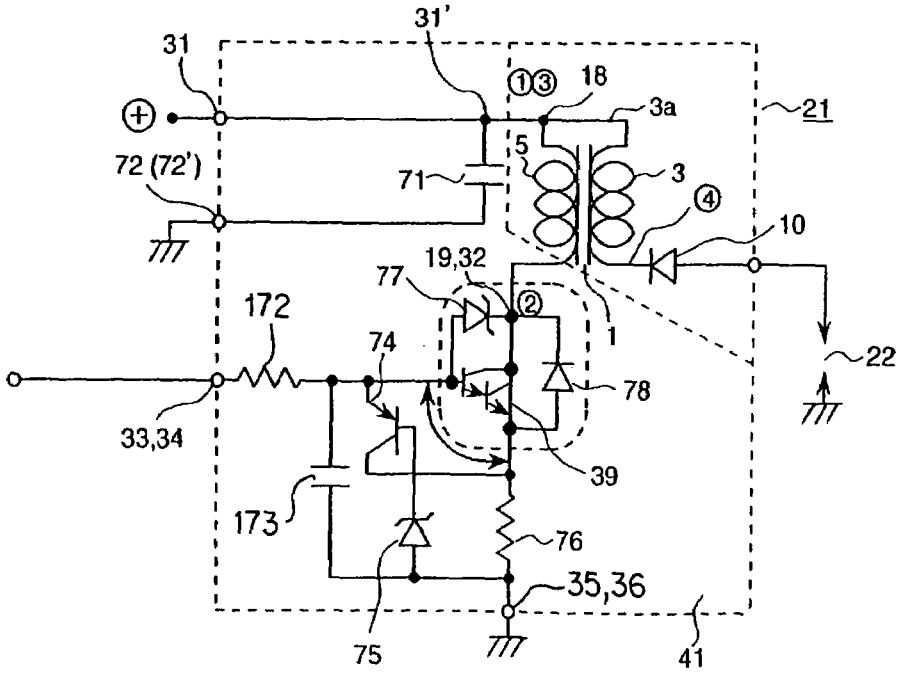
FIG. 26 is an ignition circuit view for used in the second embodiment.

Since the noise prevention capacitor 72 is provided by the above stated manner, the construction of the ignition circuit 41 in the circuit case 9 forms one shown in FIG. 26.

As stated in the above, since the noise prevention capacitor 71 is mounted in the interior portion of the circuit case 9, in comparison with the prior art following operations and effects can be expected.

(1) In the prior method, the noise prevention capacitor 71 is installed separately to the ignition coil (the pencil type coil) 21 but is installed in the power supply ground point in the harness of the engine room, however according to this installation method, since the noises of the ignition coil are transmitted to the harness which positioned between the ignition coil and the capacitor 71, so that the noises leak to the outside of the ignition coil. On the contrary to this, according to the case of the present invention, the distance from the noise source of the ignition coil to the capacitor 71 is made short extremely and further the noise prevention capacitor 71 is mounted in the interior portion of the circuit case 91, as a result the leakage of the ignition noises to the outside of the ignition coil 21 can be prevented and thus the noise prevention performance can be heightened.

(2) In the prior art method, since the noise prevention capacitor 71 is provided on the harness of the engine room, the rare state capacitor 71 is installed, there is an afraid of the corrosion by the water content and the salt content etc. which enter to the engine room. Therefore, the capacitor 71 is necessary to be covered by the resin and this invites the high cost. On the contrary to this, according to the case of the present invention, since the sealing of the insulation resin 43 in the circuit case 9 serves as the resin sealing of the capacitor 71, it is unnecessary to carry out the resin sealing for the capacitor separately from the circuit case 9 shown in the prior art, as a result the cost reduction of the capacitor 71 can be attained.

(3) In the prior art method, since the noise prevention capacitor 71 is provided on the harness of the engine room, the manufacturing process of the harness in the engine room increases. On the contrary to this, according to the case of the present invention, since the installation working for the noise prevention capacitor 71 on the harness is unnecessary, when the ignition coil 21 is mounted on the engine room, since the noise prevention capacitor 71 is installed naturally, the burden reduction for the component mounting working in the engine room of the automobile assembly can be attained.

Figure 24:
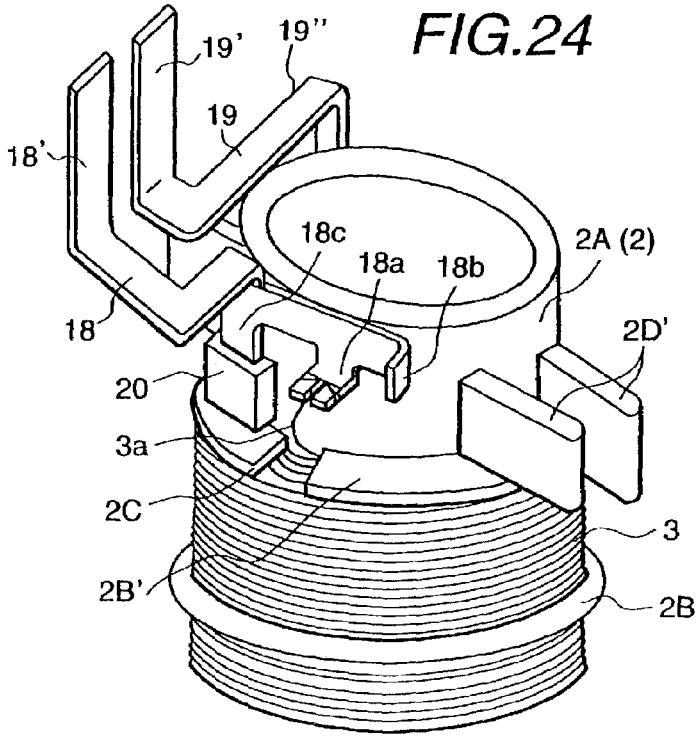
FIG. 24 is a partial squint view showing the secondary bobbin for use in the second embodiment.
Figure 25:
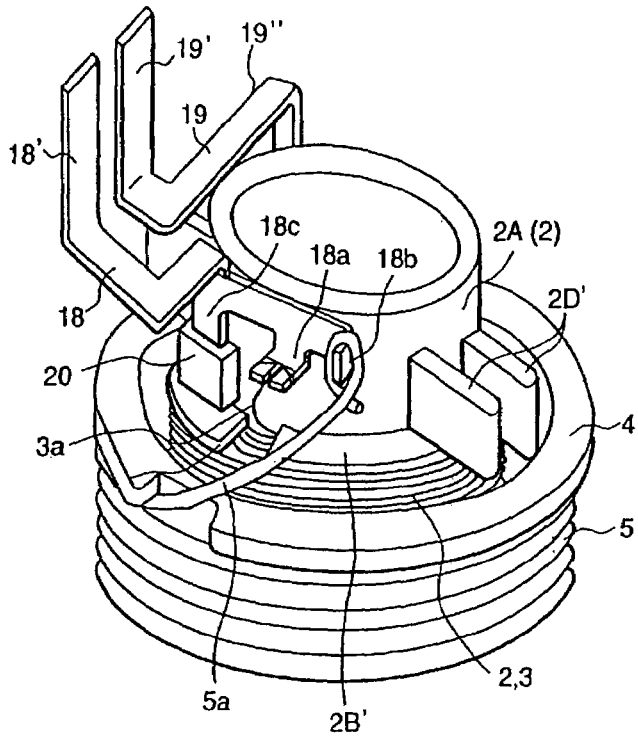
FIG. 25 is a partial squint view showing an assemble condition of the primary bobbin and the secondary bobbin for use in the second embodiment.

Further, according to this embodiment, the shape of the secondary bobbin head 2A, as shown in FIG. 24 and FIG. 25, is formed with the cylindrical shape and further the engagement portion 2D' which engages with the detent member of the winding machine is constituted by a pair of the parallel arrangement projection plates. The detent at the winding machine side is formed one strip pin embodiment (the figure is omitted) by sandwiching the above stated pair of projection plates.

Further, since the most of the spring member 13 in the ignition coil 21 is entered in the one end wall 6' of the coil case 6, the one end (the upper end) of the spring member 13 is combined with the high voltage terminal 12. A lower end (one end opposed to the high voltage terminal 12) of the spring member 13 becoming the plug combination side, at least before the combination to the spark plug 22, is projected to the outside from the lower end of the coil case 6. As a result, the length of the one end wall 6' of the coil case 6 is made short relatively against the length of the spring member 13 in comparison with those of the first embodiment (FIG. 1).

With the above stated embodiment, the ignition coil 22 is not combined (connected) to the lower end of the spring member 13 in the coil case one end cylindrical wall 6' (in the structure of the first embodiment, the substantially semi-upper portion of the ignition coil 22 is introduced to the coil case one end cylindrical wall 6' and is connected to the spring member 13 lower end). The ignition coil is combined with the lower end of the spring member 13 at a substantially same level position of the lower end opening of the cylindrical wall 6' or a lower position (the position outside of the cylindrical wall 6'). As a result, the rubber boot 14 is made longer than the lower end of the cylindrical wall 6' in the first embodiment type to compensate the short of the cylindrical wall 6' and thus the rubber boot 14 is sealing combined with the spark plug 22 at the lower position of the cylindrical wall 6'.

Figure 27:
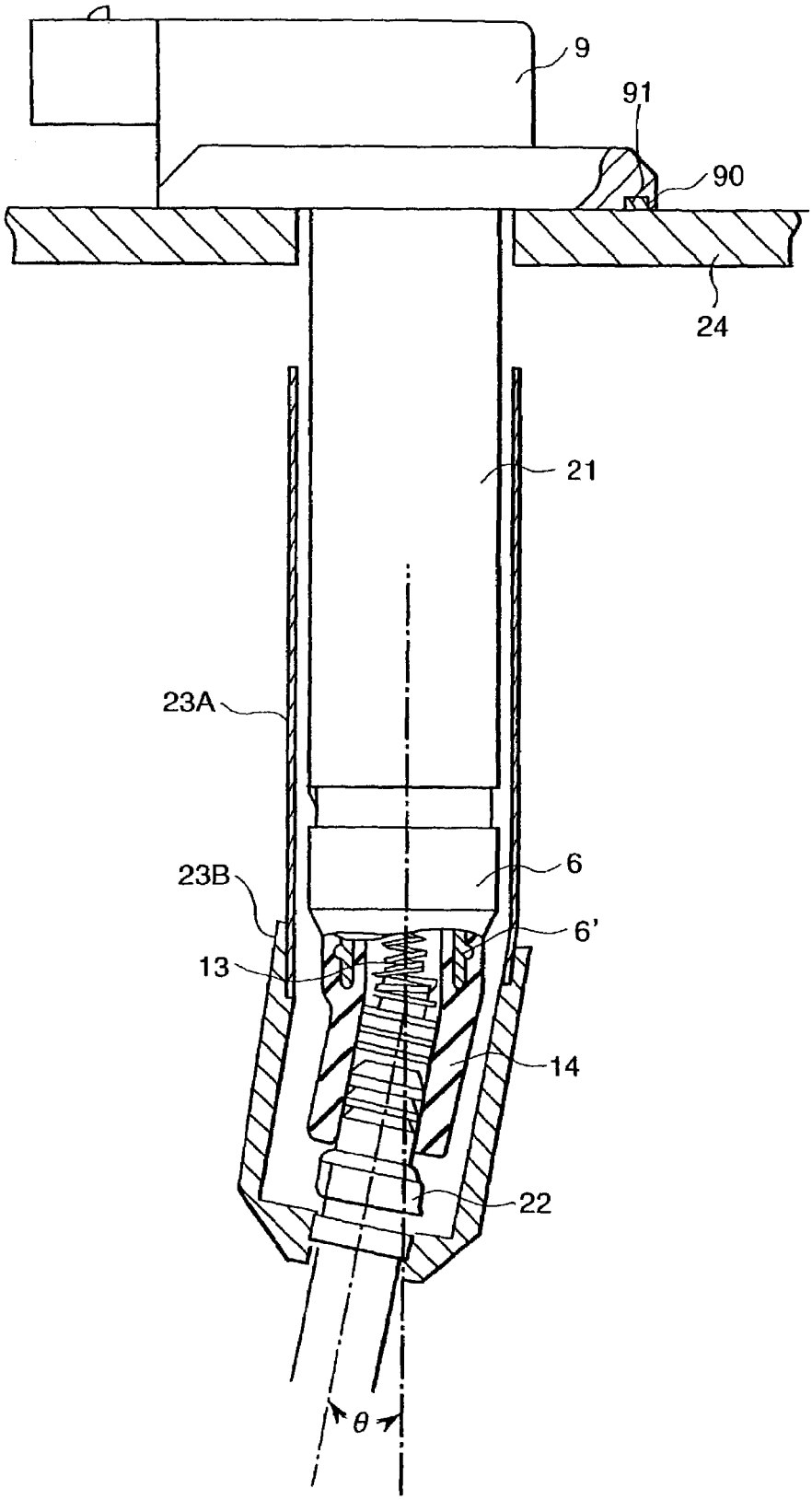
FIG. 27 is an explanatory view showing an actual mounting condition of the ignition coil of the second embodiment.
Figure 28:
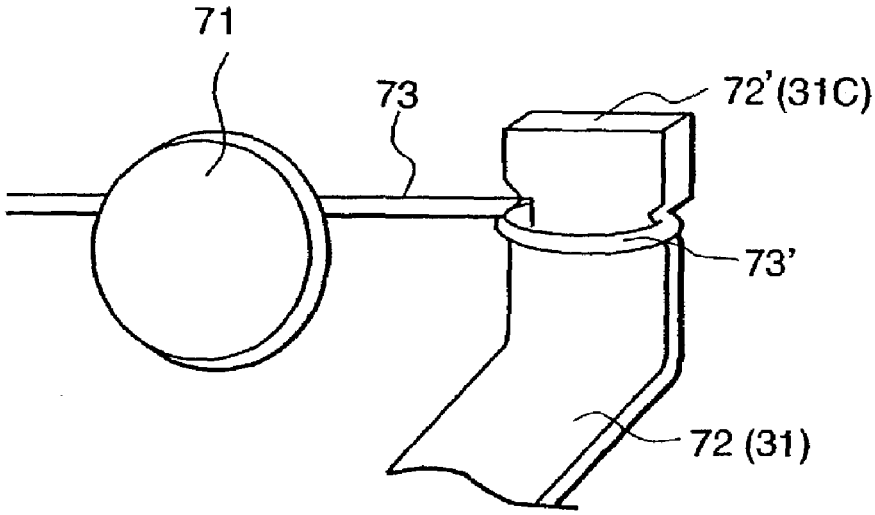
FIG. 28 is an explanatory view showing an installation condition of noise prevention capacitor for use in the second embodiment.

With the above stated construction, as shown in FIG. 27 even the relative inclination θ of exists at the axial line between the spark plug 22 and the ignition coil 21, since the spark plug 22 is not interfere to the coil case wall 7', utilizing the flexibility of the rubber boot 14 the ignition coil 21 and the spark plug 22 can be sealing combined flexible.

According to this embodiment, as shown in FIG. 27, when both the spark plug 22 and the plug hole 23B are installed with an angle θ to the engine, without the agreement of the ignition coil 21 with the axial line of the spark plug 22, the ignition coil is introduced to the plug tube 21 and the plug hole 23 and can be combined with the spark plug 22. In particularly, from the restriction of the installation space of the automobile components in a case where both the spark plug 22 and the plug hole 23B are combined with the inclination of θ, the pencil type coil mounting operation can be realized similar to that of the prior art.

Further, this kind of the ignition coil (the pencil type coil) according to the prior art is a type in which the ignition coil is agreed with the axial line of the spark plug and therefore there is taken no consideration in which the ignition coil is combined to have the spark plug 22 with the angle.

Further, the rubber boot 14 has a function in which a following creeping discharge is prevented. Namely, when the ignition coil 21 is set to the plug hole 23B, the high voltage terminal 12 of the ignition coil 21 is positioned near to the plug hole 23B. However since the plug hole 23B is grounded, when the cracks cause at a part of the cylindrical wall 6' there is an afraid of the occurrence of the creeping discharge between the high voltage terminal 12 and the plug hole 23B through the cylindrical wall 6' cracks. However, when the rubber boot 14 is installed to the cylindrical wall 6', since the distance L for contacting the high voltage terminal 12 to the rubber boot 14 is added substantially to the distance between the high voltage terminal 12 and the plug hole 23B, by holding the contact distance L long, the above stated creeping discharge can be prevented. According to the present invention, in the lower end cylindrical wall 6' of the coil case, since the distance from the position of the high voltage terminal 12 to the lowest end of the coil case cylindrical wall 6' is shortened, in the rubber boot 14 a portion which contacts to the outer side of the coil case cylindrical wall 6' is extended to near the center core 1 from the lowest end of cylindrical wall 6', as a result the distance for preventing the above stated creeping discharge can be secured. Namely, in the rubber boot 14, the side for facing to the outer face of the cylindrical wall 6' within the portion in which the rubber boot is fitted into the cylindrical wall 6' is extended longer than the side for facing the inner face of the cylindrical wall 6', as a result a total creeping discharge prevention distance can be secured long.

According to this embodiment, as stated in the above, to draw out the lower end of the spring member 13 from the lower end opening of the coil case 6, as such a manner, as stated in the above the cylindrical wall 6' of the coil case 6 lower portion is made short, however in place of this, the length at the coil case axial direction of the high voltage terminal 12 accommodated in the cylindrical wall 6' is extended over near to the lower end opening position of the coil case 6 (in other words, in the high voltage terminal 12. In accordance with the high voltage terminal 12 is extended to the lower portion in which the length of the spring member 13 is longer the position from the distance from the portion for receiving the spring member 13 to the lowest end of the coil case 6), the lower end of the spring member 13 can be drawn out outside (the lower side) from the lower end opening of the coil case 6. Since by adjusting the length of the high voltage terminal 12, the amount (the length) for drawing out from the coil case 6 lower end opening of the spring member 13 is adjusted, as a result the ignition coil 21 can be combined suitably to the spark plug (the combination through the flexible boot 14) by coping with the relative inclination θ of the spark plug 22.

In this embodiment, as shown in FIG. 27, an O ring 91 is fitted into a ring shape groove 90 which is provided at the lower face of the circuit case 9 and through this O ring 91 maintaining the sealing performance the ignition coil 21 can be installed directly on the engine cover 24 face.

The dent portion 95 is provided in the circuit case 9 and substantially by decreasing the thickness of the circuit case 9 in the shrinkage prevention during the resin molding can be attained.

With this embodiment, the similar operations and effects obtained by the first embodiment can be obtained.

Further, the arrangement construction (the circuit case inside type) of the above stated noise prevention capacitor 71 and the shape the construction of the rubber boot 14 are applied to the ignition coil of the arrangement construction in which the primary coil is inside and the secondary coil is outside.

As stated in detail in the above, according to the inventions from the first to the sixth invention, in the individual ignition type ignition coil (so called the pencil type coil) in which the secondary wire being arranged inside primary wire construction method is employed the coil is led to the plug hole, since there are taken the devices about the layer thickness of the insulation layer between the secondary coil and the center core (the insulation resin of the secondary bobbin, the soft epoxy resin etc.), the thickness structure of the secondary bobbin, the glass transition point of the insulation resin, and the stress of the secondary bobbin, and the center core pressing structure by the insulation resin. So that the improvements of the anti-heat shock performance and the electric field concentration relaxation (the insulation performance) between the secondary coil and the center core can be attained and also the quality (the reliability) and the workability on the manufacture can be heightened.

According to the seventh invention, the individual ignition type ignition coil can be adopted to the engine having the plastic head cover and also the light weight structure engine can be obtained.

What is claimed is:

1. An ignition apparatus for an internal combustion engine comprising:

a cylindrical form ignition coil portion arranged on an upper portion of the respective ignition plugs of the internal combustion engine;

a circuit case having a connector provided on said upper portion of said ignition plug coil portion, said connector comprising a power source terminal connected to a power source and a ground terminal connected to ground;

an ignition circuit unit received in said circuit case having said connector; and a condenser received in said circuit case having said connector and for restraining ignition noises which are generated by said ignition apparatus, said condenser being arranged in a space between said connector and said ignition circuit unit with said condenser being electrically connected between said power source terminal and said ground terminal.

2. An ignition apparatus for an internal combustion engine according to claim 1, wherein two projections are provided on said circuit case having said connector; and said condenser is arranged between said two projections.

3. An ignition apparatus for an internal combustion engine according to claim 1, wherein said condenser comprises a pair of lead terminals which extend in opposite directions, one of said pair of lead terminals is soldered to said power source terminal and another of said pair of lead terminals is soldered to said ground terminal.

4. An ignition apparatus for an internal combustion engine according to claim 3, wherein a pair of projection members for positioning a lateral direction of said condenser is provided at said circuit case.

5. An ignition apparatus for an internal combustion engine according to claim 1, wherein said condenser and said control circuit unit are covered by an epoxy resin member.

6. An ignition apparatus for an internal combustion engine according to claim 5, wherein said epoxy resin member is filled into a coil case in which said ignition coil is received.

7. An ignition apparatus for an internal combustion engine according to claim 1, wherein said condenser is connected electrically between a connection portion of a primary winding and a secondary winding of said ignition coil and said ground.

* * * * *